US009020158B2

(12) United States Patent
Wertz et al.

(10) Patent No.: US 9,020,158 B2
(45) Date of Patent: Apr. 28, 2015

(54) QUIET ZONE CONTROL SYSTEM

(75) Inventors: Duane Wertz, Byron, MI (US); Vasant Shridhar, Royal Oak, MI (US)

(73) Assignee: Harman International Industries, Incorporated, Northridge, CA (US)

( * ) Notice: Subject to any disclaimer, the term of this patent is extended or adjusted under 35 U.S.C. 154(b) by 787 days.

(21) Appl. No.: 12/420,658

(22) Filed: Apr. 8, 2009

(65) Prior Publication Data

US 2010/0124337 A1 May 20, 2010

Related U.S. Application Data

(63) Continuation-in-part of application No. 12/275,118, filed on Nov. 20, 2008.

(51) Int. Cl.
*G10K 11/16* (2006.01)
*G10K 11/178* (2006.01)

(52) U.S. Cl.
CPC ..... *G10K 11/1786* (2013.01); *G10K 11/1782* (2013.01); *G10K 2210/3028* (2013.01)

(58) Field of Classification Search
CPC ..... G10K 11/178; G10K 11/1784; G10K 11/1786; G10K 11/1788
USPC ..... 381/71.4, 71.11, 71.1
See application file for complete search history.

(56) References Cited

U.S. PATENT DOCUMENTS

| | | | | |
|---|---|---|---|---|
| 4,589,137 A | | 5/1986 | Miller | 381/94 |
| 4,628,156 A | | 12/1986 | Irvin | 379/410 |
| 4,654,871 A | | 3/1987 | Chaplin et al. | 381/71 |
| 4,677,678 A | | 6/1987 | McCutchen | 381/72 |
| 4,736,431 A | | 4/1988 | Allie et al. | |
| 4,910,799 A | | 3/1990 | Takayama | 455/296 |
| 4,941,187 A | | 7/1990 | Slater | 381/86 |
| 4,947,356 A | * | 8/1990 | Elliott et al. | 700/280 |
| 4,953,217 A | | 8/1990 | Twiney et al. | 381/72 |
| 4,977,600 A | | 12/1990 | Ziegler | 381/71 |

(Continued)

FOREIGN PATENT DOCUMENTS

| | | |
|---|---|---|
| CN | 1688179 A | 10/2005 |
| EP | 0 622 779 A2 | 11/1994 |

(Continued)

OTHER PUBLICATIONS

Extended European Search Report from European Application No. EP 10150426.4-2213, dated May 26, 2010, 7 pgs.

(Continued)

*Primary Examiner* — Duc Nguyen
*Assistant Examiner* — Kile Blair
(74) *Attorney, Agent, or Firm* — Brooks Kushman P.C.

(57) ABSTRACT

An active noise control system generates an anti-noise signal to drive a speaker to produce sound waves to destructively interfere with an undesired sound in a quiet zone. The anti-noise signal is generated with an adaptive filter having filter coefficients. The coefficients of the adaptive filter may be adjusted based on a first filter adjustment from a first listening region, and a second filter adjustment from a second listening region. A first weighting factor may be applied to the first filter adjustment, and a second weighting factor may be applied to the second filter adjustment. The first and second weighting factors may dictate the location and size of the quiet zone as being outside or partially within at least one of the first listening region and the second listening region.

29 Claims, 8 Drawing Sheets

(56) References Cited

U.S. PATENT DOCUMENTS 4,985,925 A 1/1991 Langberg et al. ..... 381/72
4,998,241 A 3/1991 Brox et al. ..... 370/32.1
5,001,763 A 3/1991 Moseley ..... 381/71
5,033,082 A 7/1991 Eriksson et al. ..... 379/410
5,081,682 A 1/1992 Kato et al. ..... 381/57
5,091,954 A 2/1992 Sasaki et al. ..... 381/72
5,105,377 A 4/1992 Ziegler, Jr. ..... 364/724.01
5,133,017 A 7/1992 Cain et al. ..... 381/71
5,138,664 A 8/1992 Kimura et al. ..... 381/72
5,170,433 A 12/1992 Elliot et al.
5,182,774 A 1/1993 Bourk ..... 381/71
5,208,868 A 5/1993 Sapiejewski ..... 381/183
5,251,262 A 10/1993 Suzuki et al. ..... 381/71
5,276,740 A 1/1994 Inanaga et al. ..... 381/187
5,289,147 A 2/1994 Koike et al. ..... 355/200
5,305,387 A 4/1994 Sapiejewski ..... 381/71
5,321,759 A 6/1994 Yuan ..... 381/71.9
5,337,366 A 8/1994 Eguchi et al. ..... 381/71
5,371,802 A 12/1994 McDonald et al.
5,377,276 A 12/1994 Terai et al. ..... 381/71
5,381,473 A 1/1995 Andrea et al. ..... 379/387
5,381,485 A 1/1995 Elliot
5,400,409 A 3/1995 Linhard ..... 381/92
5,425,105 A 6/1995 Lo et al. ..... 381/71
5,427,102 A 6/1995 Shimode et al. ..... 128/653.2
5,485,523 A * 1/1996 Tamamura et al. ..... 381/71.4
5,488,667 A 1/1996 Tamamura et al. ..... 387/71
5,492,129 A 2/1996 Greenberger ..... 128/715
5,493,616 A 2/1996 Iidaka et al. ..... 381/71
5,497,426 A 3/1996 Jay ..... 381/67
5,499,302 A 3/1996 Nagami et al. ..... 381/71
5,526,421 A 6/1996 Berger et al. ..... 379/389
5,559,893 A * 9/1996 Krokstad et al. ..... 381/71.7
5,586,189 A 12/1996 Allie et al. ..... 381/71
5,602,927 A 2/1997 Tamamura et al. ..... 381/71
5,602,928 A 2/1997 Eriksson et al. ..... 381/71
5,602,929 A 2/1997 Popovich
5,604,813 A 2/1997 Evans et al. ..... 381/71
5,621,803 A 4/1997 Laak ..... 381/71
5,673,325 A 9/1997 Andrea et al. ..... 381/92
5,675,658 A 10/1997 Brittain ..... 381/72
5,680,337 A 10/1997 Pedersen et al. ..... 364/724.19
5,687,075 A 11/1997 Stothers
5,689,572 A 11/1997 Ohki et al. ..... 381/71.3
5,691,893 A 11/1997 Stothers
5,692,059 A 11/1997 Kruger ..... 381/151
5,699,437 A 12/1997 Finn
5,706,344 A 1/1998 Finn ..... 379/410
5,715,320 A 2/1998 Allie et al. ..... 381/71.12
5,727,066 A 3/1998 Elliot et al.
5,737,433 A 4/1998 Gardner ..... 381/94.7
5,740,257 A 4/1998 Marcus ..... 381/71.6
5,745,396 A 4/1998 Shanbhag ..... 364/724.19
5,768,124 A 6/1998 Stothers et al.
5,774,564 A 6/1998 Eguchi et al. ..... 381/71.11
5,774,565 A 6/1998 Benning et al. ..... 381/83
5,809,156 A 9/1998 Bartels et al. ..... 381/183
5,815,582 A 9/1998 Claybaugh et al. ..... 381/71.6
5,872,728 A 2/1999 Richter ..... 364/724.2
5,937,070 A 8/1999 Todter et al. ..... 381/71.6
6,069,959 A 5/2000 Jones ..... 381/71.6
6,078,672 A 6/2000 Saunders et al. ..... 381/71.6
6,163,610 A 12/2000 Bartlett et al. ..... 379/433
6,166,573 A 12/2000 Moore et al. ..... 327/161
6,181,801 B1 1/2001 Puthuff et al. ..... 381/380
6,185,299 B1 2/2001 Goldin ..... 379/406
6,278,785 B1 8/2001 Thomasson ..... 381/66
6,295,364 B1 9/2001 Finn et al. ..... 381/110
6,301,364 B1 10/2001 Lowmiller et al. ..... 381/66
6,343,127 B1 * 1/2002 Billoud ..... 381/71.4
6,347,146 B1 2/2002 Short et al. ..... 381/15
6,377,680 B1 4/2002 Foladare et al. ..... 379/392.01
6,421,443 B1 7/2002 Moore et al. ..... 379/406.01
6,445,799 B1 9/2002 Taenzer et al. ..... 381/71.6
6,445,805 B1 9/2002 Grugel ..... 381/330
6,466,673 B1 10/2002 Hardy
6,496,581 B1 12/2002 Finn et al. ..... 379/406.01
6,505,057 B1 1/2003 Finn et al. ..... 455/569
6,529,605 B1 3/2003 Christoph
6,532,289 B1 3/2003 Magid ..... 379/406.01
6,532,296 B1 3/2003 Vaudrey et al. ..... 381/371
6,567,524 B1 5/2003 Svean et al. ..... 381/71.1
6,567,525 B1 5/2003 Sapiejewski ..... 381/71.6
6,597,792 B1 7/2003 Sapiejewski et al. ..... 381/71.6
6,625,286 B1 9/2003 Rubacha et al. ..... 381/93
6,633,894 B1 10/2003 Cole ..... 708/300
6,643,619 B1 11/2003 Linhard et al. ..... 704/233
6,665,410 B1 12/2003 Parkins ..... 381/71.1
6,687,669 B1 2/2004 Schrogmeier et al. ..... 704/226
6,690,800 B2 2/2004 Resnick ..... 381/73.1
6,798,881 B2 9/2004 Thomasson ..... 379/406.07
6,845,162 B1 1/2005 Emborg et al. ..... 381/71.4
6,991,289 B2 1/2006 House ..... 297/217.4
7,020,288 B1 * 3/2006 Ohashi ..... 381/71.4
7,062,049 B1 6/2006 Inoue et al. ..... 381/71.4
7,103,188 B1 9/2006 Jones ..... 381/71.9
7,133,529 B2 11/2006 Ura ..... 381/66
7,317,801 B1 1/2008 Amir
7,333,618 B2 2/2008 Shuttleworth et al. ..... 381/57
7,440,578 B2 10/2008 Arai et al. ..... 381/302
7,469,051 B2 12/2008 Sapashe et al. ..... 381/104
7,536,018 B2 5/2009 Onishi et al. ..... 381/71.8
7,574,006 B2 8/2009 Funayama et al. ..... 381/71.12
7,627,352 B2 12/2009 Gauger, Jr. et al. ..... 455/569.1
7,630,432 B2 12/2009 Hofmeister ..... 375/232
7,773,760 B2 8/2010 Sakamoto et al. ..... 381/71.9
7,808,395 B2 * 10/2010 Raisanen et al. ..... 340/667
7,873,173 B2 1/2011 Inoue et al. ..... 381/71.4
7,885,417 B2 2/2011 Christoph ..... 381/71.11
7,933,420 B2 4/2011 Copley et al. ..... 381/71.11
8,027,484 B2 9/2011 Yoshida et al. ..... 381/71.4
2001/0036283 A1 11/2001 Donaldson ..... 381/71.11
2001/0053532 A1 12/2001 Elliott et al.
2002/0068617 A1 6/2002 Han
2002/0076059 A1 6/2002 Joynes ..... 381/71.6
2002/0138263 A1 9/2002 Deligne et al. ..... 704/233
2002/0143528 A1 10/2002 Deligne et al. ..... 704/224
2002/0172374 A1 11/2002 Bizjak ..... 381/71.14
2002/0176589 A1 11/2002 Buck et al. ..... 381/94.7
2003/0035551 A1 2/2003 Light et al. ..... 381/71.6
2003/0103636 A1 6/2003 Arai et al. ..... 381/302
2003/0142841 A1 7/2003 Wiegand ..... 381/172
2003/0228019 A1 12/2003 Eichler et al. ..... 381/71.8
2004/0037429 A1 2/2004 Candioty ..... 381/67
2004/0076302 A1 4/2004 Christoph ..... 381/57
2005/0063552 A1 3/2005 Shuttleworth et al.
2005/0175187 A1 8/2005 Wright et al. ..... 381/71.12
2005/0207585 A1 9/2005 Christoph ..... 381/71.11
2005/0226434 A1 10/2005 Franz et al. ..... 381/71.7
2005/0232435 A1 10/2005 Stothers et al.
2006/0098809 A1 5/2006 Nongpiur et al. ..... 379/406.14
2006/0153394 A1 7/2006 Beasley ..... 381/57
2006/0251266 A1 11/2006 Saunders et al. ..... 381/71.1
2006/0262935 A1 * 11/2006 Goose et al. ..... 381/17
2007/0098119 A1 5/2007 Stothers et al.
2007/0253567 A1 11/2007 Sapiejewski ..... 381/71.6
2007/0274531 A1 11/2007 Camp ..... 381/74
2008/0095383 A1 4/2008 Pan et al. ..... 381/71.11
2008/0152158 A1 6/2008 Sakamoto et al.
2008/0181422 A1 7/2008 Christoph ..... 381/73.1
2008/0192948 A1 8/2008 Kan et al. ..... 381/71.4
2008/0247560 A1 10/2008 Fukuda et al. ..... 381/71.6
2009/0067638 A1 3/2009 Sakamoto et al. ..... 381/71.4
2009/0086990 A1 4/2009 Christoph ..... 381/71.12
2009/0086995 A1 4/2009 Christoph et al.
2009/0220102 A1 9/2009 Pan et al. ..... 381/71.11
2009/0279710 A1 11/2009 Onishi et al.
2010/0002892 A1 1/2010 Togawa et al.
2010/0014685 A1 1/2010 Wurm ..... 381/71.11
2010/0061566 A1 3/2010 Moon et al. ..... 381/71.8
2010/0098263 A1 4/2010 Pan et al. ..... 381/71.11
2010/0098265 A1 4/2010 Pan et al. ..... 381/94.1
2010/0124336 A1 5/2010 Shridhar et al. ..... 371/71.4
2010/0177905 A1 7/2010 Shridhar et al. ..... 381/71.11

(56) References Cited

U.S. PATENT DOCUMENTS

| | | | | |
|---|---|---|---|---|
| 2010/0226505 | A1 | 9/2010 | Kimura | 381/71.6 |
| 2010/0239105 | A1 | 9/2010 | Pan | 381/94.9 |
| 2010/0260345 | A1 | 10/2010 | Shridhar et al. | 381/71.1 |
| 2010/0266134 | A1 | 10/2010 | Wertz et al. | 381/71.1 |
| 2010/0266137 | A1 | 10/2010 | Sibbald et al. | 381/71.6 |
| 2010/0272275 | A1 | 10/2010 | Carreras et al. | |
| 2010/0272276 | A1 | 10/2010 | Carreras et al. | 381/71.6 |
| 2010/0272280 | A1 | 10/2010 | Joho et al. | 381/71.6 |
| 2010/0272281 | A1 | 10/2010 | Carreras et al. | 381/71.6 |
| 2010/0274564 | A1 | 10/2010 | Bakalos et al. | 704/500 |
| 2010/0290635 | A1 | 11/2010 | Shridhar et al. | 381/71.1 |
| 2010/0296669 | A1 | 11/2010 | Oh et al. | 381/109 |
| 2011/0116643 | A1 | 5/2011 | Tiscareno et al. | 381/58 |
| 2012/0170763 | A1 | 7/2012 | Shridhar et al. | 381/71.1 |
| 2012/0170764 | A1 | 7/2012 | Shridhar et al. | 381/71.1 |

FOREIGN PATENT DOCUMENTS

| | | | |
|---|---|---|---|
| EP | 0 539 940 | B1 | 4/1996 |
| EP | 0 572 492 | B1 | 11/1997 |
| EP | 0 898 266 | A2 | 2/1999 |
| EP | 1 653 445 | A1 | 5/2006 |
| EP | 1 577 879 | B1 | 7/2008 |
| EP | 1 947 642 | A1 | 7/2008 |
| EP | 2 133 866 | A1 | 12/2009 |
| EP | 2 284 831 | A1 | 2/2011 |
| GB | 2 293 898 | B | 4/1996 |
| JP | 61-112496 | | 5/1986 |
| JP | 5-011772 | | 1/1993 |
| JP | 5-173581 | | 7/1993 |
| JP | H06-004085 | | 1/1994 |
| JP | H06-043881 | | 2/1994 |
| JP | 6-118968 | | 4/1994 |
| JP | 06-318085 | | 11/1994 |
| JP | 06-332474 | | 12/1994 |
| JP | 07-056583 | | 3/1995 |
| JP | 08-095579 | | 4/1996 |
| JP | 08-234767 | | 9/1996 |
| JP | 10-207470 | | 8/1998 |
| JP | 11 259078 | A | 9/1999 |
| JP | 2000-330572 | | 11/2000 |
| JP | 2006-126841 | | 5/2006 |
| JP | 2007-243739 | | 9/2007 |
| JP | 2007-253799 | | 10/2007 |
| WO | WO 90/09655 | | 8/1990 |
| WO | WO 94/09480 | | 4/1994 |
| WO | WO 94/09481 | | 4/1994 |
| WO | WO 94/09482 | | 4/1994 |
| WO | WO 95/09415 | | 4/1995 |
| WO | WO 95/26521 | | 10/1995 |
| WO | WO 96/10780 | | 4/1996 |
| WO | WO 2007/011010 | A1 | 1/2007 |
| WO | WO 2008/126287 | A1 | 10/2008 |

OTHER PUBLICATIONS

Martins C R et al., "Fast Adaptive Noise Canceller Using the LMS Algorithm", Proceedings of the International Conference on Signal Processing Applications and Technology, vol. 1, Sep. 28, 1993, 8 pgs.
European Search Report from European Application No. EP 10162225, dated Oct. 1, 2010, 5 pgs.
Gonzalez, A. et al., "Minimisation of the maximum error signal in active control", IEEE International Conference on Acoustics, Speech, and Signal Processing, 1997, 4 pgs.
Colin H. Hansen et al., "Active Control of Noise and Vibration," E & FN Spon., London SE1, Copyright 1997, pp. 642-652.
Gao, F. X. Y. et al., "An Adaptive Backpropagation Cascade IIR Filter," *IEEE*, vol. 39, No. 9, 1992, pp. 606-610.
Kuo, S. M. et al., "Active Noise Control Systems: Algorithms and DSP Implementations," John Wiley & Sons, Inc., New York, NY, Copyright 1996, pp. 88-97.
Office Action, dated Aug. 26, 2011, pp. 1-24, U.S. Appl. No. 12/421,459, U.S. Patent and Trademark Office, Virginia.
Office Action, dated Jul. 25, 2011, pp. 1-11, U.S. Appl. No. 12/275,118, U.S. Patent and Trademark Office, Virginia.
Office Action, dated Aug. 3, 2011, pp. 1-33, U.S. Appl. No. 12/352,435, U.S. Patent and Trademark Office, Virginia.
Office Action, dated Aug. 17, 2011, pp. 1-26, U.S. Appl. No. 12/425,997, U.S. Patent and Trademark Office, Virginia.
Notice of Allowance, dated Aug. 15, 2011, pp. 1-14, U.S. Appl. No. 12/466,282, U.S. Patent and Trademark Office, Virginia.
Chen, Kean et al., Adaptive Active Noise Elimination and Filter-XLMS Algorithm, 1993, pp. 27-33, vol. 12 (4), Applied Acoustics, and translation of Abstract (8 pgs.).
Kuo, S. M. et al., "Active Noise Control Systems: Algorithms and DSP Implementations," John Wiley & Sons, Inc., New York, NY, Copyright 1996, 418 pgs.
Office Action, dated Feb. 14, 2012, pp. 1-36, U.S. Appl. No. 12/352,435, U.S. Patent and Trademark Office, Virginia.
Notice of Allowance, dated Feb. 2, 2012, U.S. Appl. No. 12/421,459, U.S. Patent and Trademark Office, Virginia.
Notice of Allowance, dated Jan. 13, 2012, U.S. Appl. No. 12/425,997, U.S. Patent and Trademark Office, Virginia.
Notice of Allowance, dated Nov. 2, 2011, pp. 1-9, U.S. Appl. No. 12/275,118, U.S. Patent and Trademark Office, Virginia.
Japanese Office Action, dated Mar. 8, 2012, pp. 1-8, Japanese Patent Application No. 2010-089052, Japanese Patent Office, Japan.
U.S. Office Action, dated May 31, 2013, pp. 1-34, issued in U.S. Appl. No. 12/352,435, U.S. Patent and Trademark Office, Alexandria, Virginia.
Chinese Office Action with full English translation, dated Apr. 19, 2013, pp. 1-14, issued in Chinese Patent Application No. 201010214748.3, State Intellectual Property Office, Beijing, China.
European Search Report, dated Jun. 4, 2013, pp. 1-6, issued in European Patent Application No. 10158681.6, European Patent Office, Rijswijk, The Netherlands.
Kuo, Sen M. et al., Active Noise Control: A Tutorial Review, Jun. 1999, pp. 943-972, vol. 87, No. 6, Proceedings of the IEEE.
Chinese Office Action, dated Jul. 3, 2012, pp. 1-10, Chinese Patent Application No. 201010214748.3, Chinese Patent Office, China.
Notice of Allowance, dated Jul. 16, 2012, pp. 1-14, U.S. Appl. No. 13/418,095 U.S. Patent and Trademark Office, Virginia.
Notice of Allowance, dated May 15, 2012, pp. 1-7, U.S. Appl. No. 13/419,420 U.S. Patent and Trademark Office, Virginia.
Examination Report for European Application No. 10 158 681.6 dated Feb. 26, 2014.
Japanese Office Action mailed May 2, 2014 for Japanese Patent Application No. 2012-138927, filed Nov. 10, 2006, pp. 1-4.

* cited by examiner

QUIET ZONE CONTROL SYSTEM

PRIORITY CLAIM

The present patent document is a continuation-in-part of U.S. patent application Ser. No. 12/275,118, filed Nov. 20, 2008 entitled SYSTEM FOR ACTIVE NOISE CONTROL WITH AUDIO SIGNAL COMPENSATION. The disclosure of U.S. patent application Ser. No. 12/275,118 is incorporated herein by reference.

BACKGROUND OF THE INVENTION

1. Technical Field

This invention relates to active noise control, and more specifically to adjustment of the size and/or shape of one or more quiet zones within a listening space where the active noise control is functioning to reduce undesired sound.

2. Related Art

Active noise control may be used to generate sound waves or "anti noise" that destructively interferes with undesired sound waves. The destructively interfering sound waves may be produced through a loudspeaker to combine with the undesired sound waves in an attempt to cancel the undesired noise. Combination of the destructively interfering sound waves and the undesired sound waves can eliminate or minimize perception of the undesired sound waves by one or more listeners within a listening space.

An active noise control system generally includes one or more microphones to detect sound within an area that is targeted for destructive interference. The detected sound is used as a feedback error signal. The error signal is used to adjust an adaptive filter included in the active noise control system. The filter generates an anti-noise signal used to create destructively interfering sound waves. The filter is adjusted to adjust the destructively interfering sound waves in an effort to optimize cancellation within the area. Larger areas may result in more difficultly optimizing cancellation. Moreover, in many cases, listeners are only in certain areas within a larger listening area. Therefore, a need exists to optimize cancellation within one or more regions within the larger listening area. In addition, a need exists to adjust optimized cancellation to occur in the different regions.

SUMMARY

An active noise control (ANC) system may generate one or more anti-noise signals to drive one or more respective speakers. The speakers may be driven to generate sound waves to destructively interfere with undesired sound present in one or more quiet zones within a listening space. The ANC system may generate the anti-noise signals based on input signals representative of the undesired sound.

The ANC system may include any number of anti-noise generators each capable of generating an anti-noise signal. Each of the anti-noise generators may include one or more learning algorithm units (LAU) and adaptive filters. The LAU may receive error signals in the form of microphone input signals from microphones positioned in different listening regions within a listening area, such as from different rows of seating (listening regions) in a passenger cabin (listening area) of a vehicle. The LAU may also receive a filtered estimated undesired noise signal representative of an estimate of the undesired noise at each of the different seating locations. The filtered estimated undesired noise signal may be calculated based upon estimated secondary path transfer functions that are an estimate of the physical path from the source of the undesired noise to each of the microphones. Based upon the error signals and the filtered estimate of the undesired noise, the LAU may calculate a filter update for each of the listening regions.

The ANC system may also retrieve a weighting factor for each of the filter updates. The weighting factors may shape one or more quiet zones produced by the ANC system within the listening area. The weighting factors may be static resulting in one or more quiet zones in the listening space that remain unchanged. Alternatively, or in addition, the weighting factors may be variable based on parameters such as a configuration of occupants within the listening area.

Based upon a set of weighting factors applied to the filter updates of an anti-noise generator, the anti-noise signal from the anti-noise generator may produce a quiet zone of a certain three dimensional area in a certain location. Since each of the anti-noise generators calculate filter updates for each of the listening regions in the listening area, the quiet zone produced by a respective adaptive filter may include only one, or more than one of the listening regions depending on the weighting factors being applied. In addition, each of the anti-noise generators may produce corresponding quiet zones that are non-overlapping, partially overlapping, or completely overlapping based on the respective weighting factors.

Accordingly, using the weighting factors, the ANC system may selectively produce one or more quiet zones in a listening area that may encompass one or more listening regions. Thus, in an example application of the ANC system within a vehicle, the ANC system may apply weighting factors to produce a separate quiet zone for the driver, the front seat passenger, and each of the rear seat passengers, or a first quiet zone for the front seating area and a second quiet zone for the rear seating area. The quiet zones produced in this example may also be adjusted based on occupancy in the vehicle such that quiet zones are produced with an area only encompassing seating locations being occupied by a passenger in the vehicle.

The number and size of the quiet zones may also be selected or created by a user of the ANC system. Based on user selections, corresponding weighting factors may be determined, retrieved and applied to the filter updates of the adaptive filters in each of the anti-noise generators. Once updated, each of the updated adaptive filters may generate anti-noise signals to create the desired quiet zones.

Other systems, methods, features and advantages of the invention will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The system may be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE PREFERRED EMBODIMENTS

An active noise cancellation (ANC) system is configured to generate destructively interfering sound waves to create one or more quiet zones. The destructively interfering sound waves may be generated with audio compensation. In general, this is accomplished by first determining the presence of an undesired sound and generating a destructively interfering sound wave. A destructively interfering signal may be included as part of a speaker output along with an audio signal. A microphone may receive the undesired sound and sound waves from a loudspeaker driven with the speaker output. The microphone may generate an input signal based on the received sound waves. A component related to the audio signal may be removed from the input signal to generate an error signal.

The error signal may be used in conjunction with an estimate of the undesired signal to generate a filter adjustment for an adaptive filter. The adaptive filter may generate an anti-noise signal used to optimize cancellation of the undesired sound in a quiet zone or listening region included in a listening area. Different weighting of the filter adjustment may be used to adapt the adaptive filter differently based on the corresponding size and location of each of the quiet zones to be created. A destructively interfering signal that drives a respective loudspeaker to produce a destructively interfering sound wave for the quiet zone or listening region may be generated with the adaptive filter based on the weighting of the filter adjustment.

As used herein, the term "quiet zone" or "listening region" refers to a three-dimensional area of space within which perception by a listener of an undesired sound is substantially reduced due to destructive interference by combination of sound waves of the undesired sound and anti-noise sound waves generated by one or more speakers. For example, the undesired sound may be reduced by approximately half, or 3 dB down within the quiet zone. In another example, the undesired sound may be reduced in magnitude to provide a perceived difference in magnitude of the undesired sound to a listener. In still another example, the undesired sound may be minimized as perceived by a listener.

Figure 1:
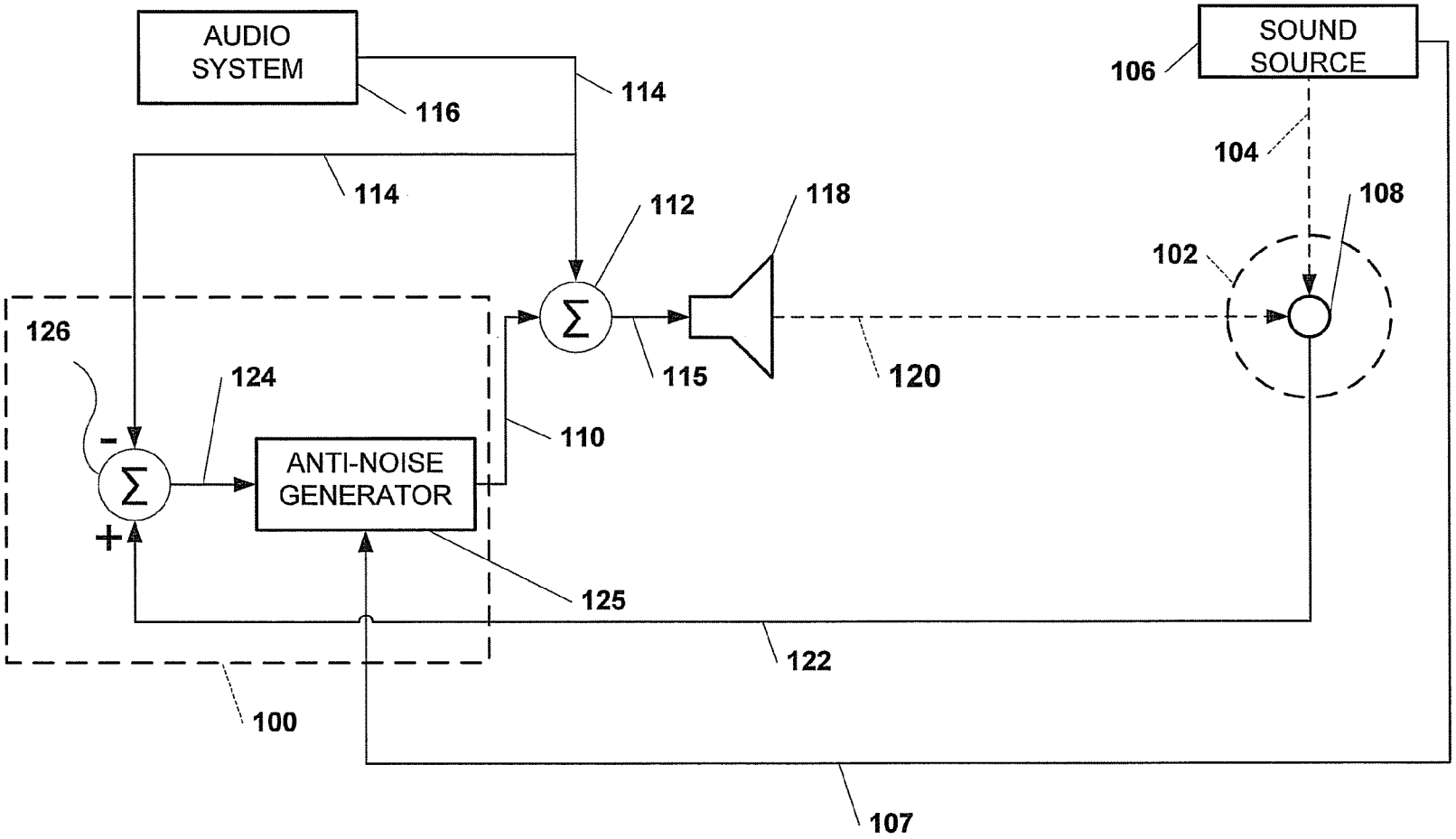
FIG. 1 is a diagrammatic view of an example active noise cancellation (ANC) system.

FIG. 1 is an example of an active noise control (ANC) system 100. The ANC system 100 may be implemented in various listening areas, such as a vehicle interior, to reduce or eliminate a particular sound frequency or frequency ranges from being audible in a quiet zone 102 or listening region within the listening area. The example ANC system 100 of FIG. 1 is configured to generate signals at one or more desired frequencies or frequency ranges that may be generated as sound waves to destructively interfere with undesired sound 104, represented by a dashed-arrow in FIG. 1, originating from a sound source 106. In one example, the ANC system 100 may be configured to destructively interfere with undesired sound within a frequency range of approximately 20-500 Hz. The ANC system 100 may receive an undesired sound signal 107 indicative of sound emanating from the sound source 106 that is audible in the quiet zone 102.

A sensor such as a microphone 108, or any other device or mechanism for sensing sound waves may be placed in the quiet zone 102. The ANC system 100 may generate an anti-noise signal 110. In one example the anti-noise signal 110 may ideally be representative of sound waves of approximately equal amplitude and frequency that are approximately 180 degrees out of phase with the undesired sound 104 present in the quiet zone 102. The 180 degree phase shift of the anti-noise signal 110 may cause desirable destructive interference with the undesired sound in an area within the quiet zone 102 in which the anti-noise sound waves and the undesired sound 104 sound waves destructively combine. The desirable destructive interference results in cancellation of the undesired sound within the area, as perceived by a listener.

In FIG. 1, the anti-noise signal 110 is shown as being summed at summation operation 112 with an audio signal 114, generated by an audio system 116. The combined anti-noise signal 110 and audio signal 114 are provided as a combined signal 115 to drive a speaker 118 to produce a speaker output 120. The speaker output 120 is an audible sound wave that may be projected towards the microphone 108 within the quiet zone 102. The anti-noise signal 110 component of the sound wave produced as the speaker output 120 may destructively interfere with the undesired sound 104 within the quiet zone 102.

The microphone 108 may generate a microphone input signal 122 based on detection of the combination of the speaker output 120 and the undesired noise 104, as well as other audible signals within range of being received by the microphone 108. The microphone input signal 122 may be used as an error signal to adjust the anti-noise signal 110. The microphone input signal 122 may include a component representative of any audible signal received by the microphone 108 that is remaining from the combination of the anti-noise 110 and the undesired noise 104. The microphone input signal 122 may also contain a component representative of any audible portion of the speaker output 120 resulting from output of a sound wave representative of the audio signal 114. The component representative of the audio signal 114 may be removed from the microphone input signal 108 allowing the anti-noise signal 110 to be generated based upon an error signal 124.

The ANC system 100 may remove a component representative of the audio signal 114 from the microphone input signal 122 at summation operation 126, which, in one example, may be performed by inverting the audio signal 114 and adding it to the microphone input signal 122. The result is the error signal 124, which is provided as input to an anti-noise generator 125 of the ANC system 100. The anti-noise generator 125 may produce the anti-noise signal 110 based on the error signal 124 and the undesired sound signal 107. In other examples, summation of the audio signal 114 and the microphone input signal 122 may be omitted resulting in the microphone input signal 122 and the error signal 124 being the same signal.

The ANC system 100 may dynamically adjust the anti-noise signal 110 based on the error signal 124 and the undesired sound signal 107 to more accurately produce the anti-noise signal 110 to destructively interfere with the undesired sound 104 within the quiet zone 102. The removal of a component representative of the audio signal 114 may allow the error signal 124 to more accurately reflect any differences between the anti-noise signal 110 and the undesired sound 104. Allowing a component representative of the audio signal 114 to remain included in the error signal input to the anti-noise generator 125 may cause the anti-noise generator 125 to generate an anti-noise signal 110 that includes a signal component to destructively combine with sound waves generated based on the audio signal 114. Thus, the ANC system 100 may also cancel or reduce sounds associated with the audio system 116, which may be undesired. Also, the anti-noise signal 110 may be undesirably altered such that any generated anti-noise is not accurately tracking the undesired noise 104 due to the audio signal 114 being included. Thus, removal of a component representative of the audio signal 114 to generate the error signal 124 may enhance the fidelity of the audio sound generated by the speaker 118 from the audio signal 114, as well as more efficiently reduce or eliminate the undesired sound 104.

The anti-noise generator 125 may also include a weighting to adapt a size and location of the quiet zone 102 created with the anti-noise signal 110. Weighting within the anti-noise generator to produce the quiet zone may be based on predetermined weighting factors. The weighting factors may be static and uniformly applied to produce the anti-noise signal 110, or the weighting factors may be adjustable based on operating conditions and/or parameters associated with the ANC system 100.

Figure 2:
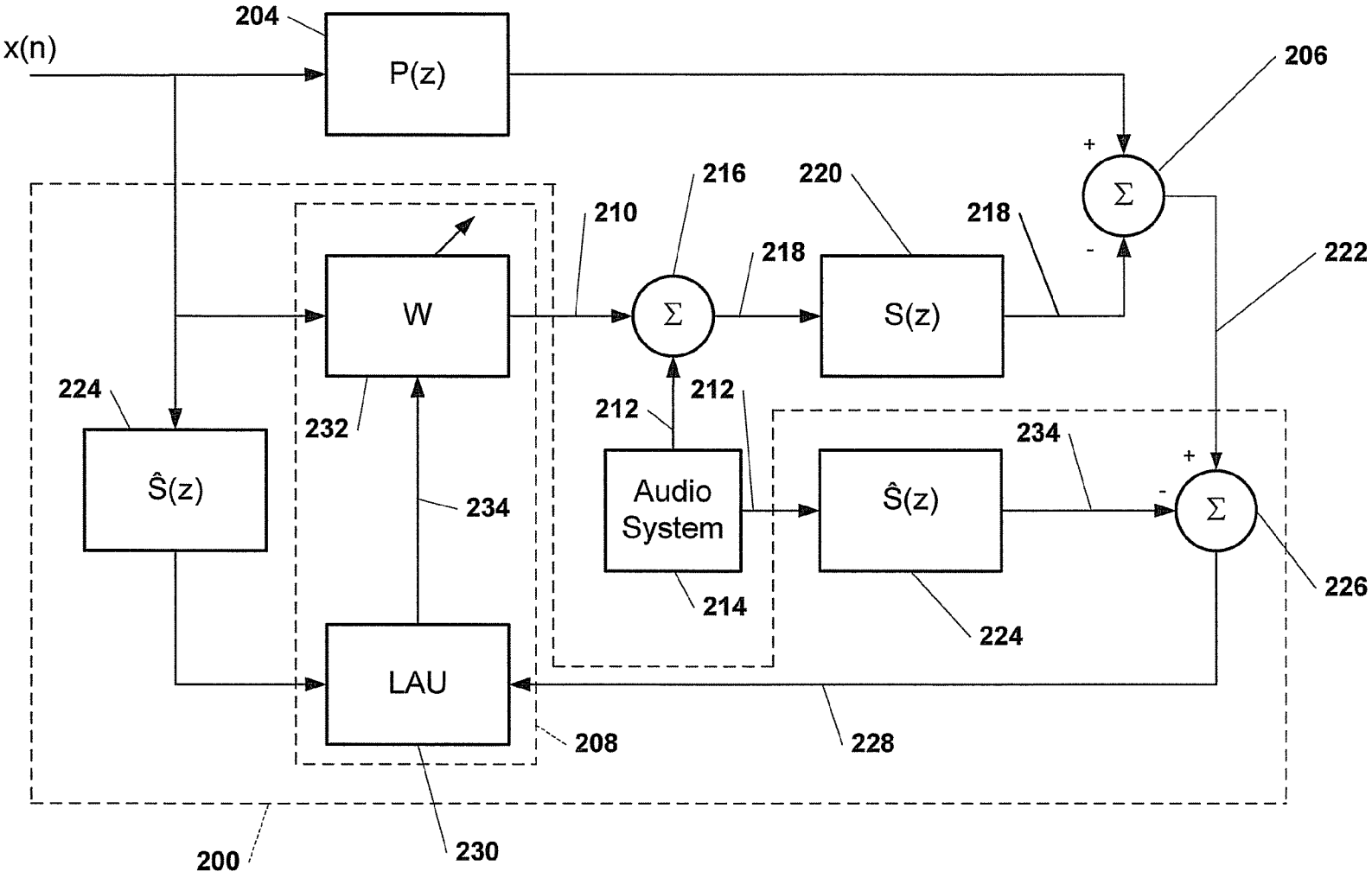
FIG. 2 is a block diagram of an example configuration implementing an ANC system.

FIG. 2 is a block diagram example of ANC system 200 and an example physical environment. The ANC system 200 may operate in a manner similar to the ANC system 100 as described with regard to FIG. 1. In one example, an undesired sound x(n) may traverse a physical path 204 from a source of the undesired sound x(n) to a microphone 206. The physical path 204 may be represented by a Z-domain transfer function P(z). In FIG. 2, the undesired sound x(n) represents the undesired sound both physically and as a digital representation such as from the use of an analog-to-digital (A/D) converter. In FIG. 2, the undesired sound x(n) may also be used as an input to the ANC system 200. In other examples, the ANC system 200 may simulate the undesired sound x(n).

The ANC system 200 may include an anti-noise generator 208. The anti-noise generator 208 may generate an anti-noise signal 210. The anti-noise signal 210 and an audio signal 212 generated by an audio system 214 may be combined to drive a speaker 216. The combination of the anti-noise signal 210 and the audio signal 212 may produce a sound wave output from the speaker 216. The speaker 216 is represented by a summation operation in FIG. 2 having a speaker output 218. The speaker output 218 may be a sound wave that travels a physical path 220 that includes a path from the speaker 216 to the microphone 206. The physical path may also include A/D converters, digital-to-analog (D/A) converters, amplifiers, filters, and any other physical or electrical components with an impact on an undesired sound. The physical path 220 may be represented in FIG. 2 by a Z-domain transfer function S(z). The speaker output 218 and the undesired noise x(n) may be received by the microphone 206 and a microphone input signal 222 may be generated by the microphone 206. In other examples, any number of speakers and microphones may be present.

A component representative of the audio signal 212 may be removed from the microphone input signal 222, through processing of the microphone input signal 222. In FIG. 2, the audio signal 212 may be processed to reflect the traversal of the physical path 220 by the sound wave of the audio signal 212. This processing may be performed by estimating the physical path 220 as an estimated path filter 224, which provides an estimated effect on an audio signal sound wave traversing the physical path 220. The estimated path filter 224 is configured to simulate the effect on the sound wave of the audio signal 212 of traveling through the physical path 220 and generate an output signal 234. The estimated path filter 224 may be represented as one or more secondary path transfer functions, such as a Z-domain transfer function S(z).

The microphone input signal 222 may be processed such that a component representative of the audio signal 234 is removed as indicated by a summation operation 226. This may occur by inverting the filtered audio signal at the summation operation 226 and adding the inverted signal to the microphone input signal 222. Alternatively, the filtered audio signal could be subtracted by any other mechanism or method to remove the audio signal 234. The output of the summation operation 226 is an error signal 228, which may represent an audible signal remaining after destructive interference between the anti-noise signal 210 projected through the speaker 216 and the undesired noise x(n). The summation operation 226 removing a component representative of the audio signal 234 from the input signal 222 may be considered as being included in the ANC system 200. In other examples, subtraction of the audio signal 234 may be omitted and the microphone input signal 222 may be the error signal 228.

The error signal 228 is transmitted to the anti-noise generator 208. The anti-noise generator 208 includes a learning algorithm unit (LAU) 230 and an adaptive filter (W) 232. The error signal 228 is provided as an input to the LAU 230. The LAU 230 also may receive as an input the undesired noise x(n) filtered by the estimated path filter 224. Alternatively, the LAU 230 may receive as an input a simulation of the undesired noise x(n). The LAU 230 may implement various learning algorithms, such as least mean squares (LMS), recursive least mean squares (RLMS), normalized least mean squares (NLMS), or any other suitable learning algorithm to process the error signal 228 and the filtered undesired noise x(n) to generate a filter update signal 234. The filter update signal 234 may be an update to filter coefficients included in the adaptive filter 232.

Figure 3:
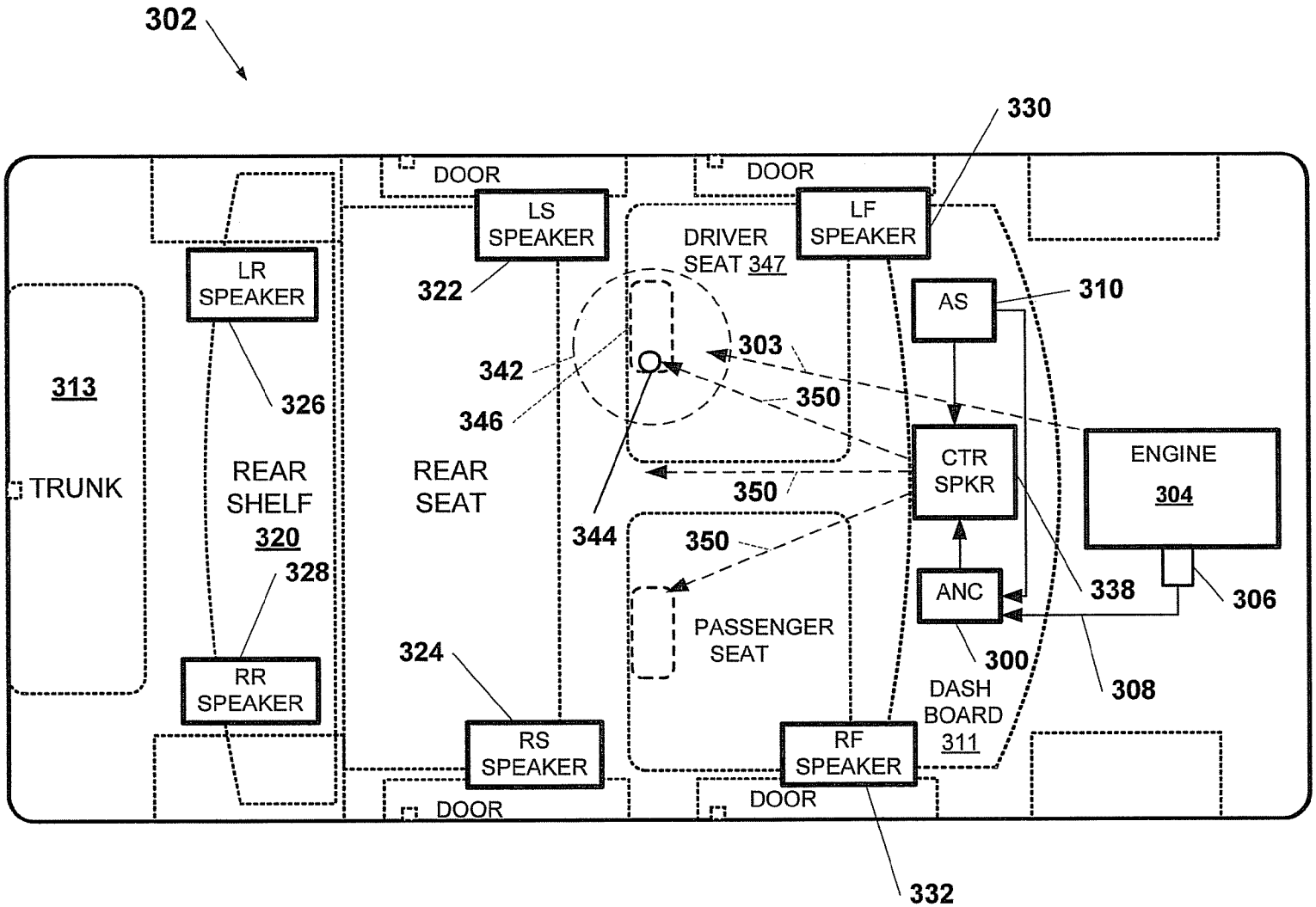
FIG. 3 is a top view of an example vehicle implementing an ANC system.

The adaptive filter (W) 232 may be represented by a Z-domain transfer function W(z). The adaptive filter 232 may be a digital filter that includes filter coefficients. The filter coefficients may be adjusted to dynamically adapt the adaptive filter 232 in order to filter an input to produce the desired anti-noise signal 210 as an output. In FIG. 3, the input to the adaptive filter 232 is the undesired noise x(n). In other examples, the adaptive filter 232 may receive a simulation of the undesired noise x(n).

The adaptive filter 232 is configured to receive the undesired noise x(n) (or a simulation of the undesired noise x(n)) and the filter update signal 234 from the LAU 230. The filter update signal 234 is a filter update transmitted to the adaptive filter 232 to update the filter coefficients forming the adaptive filter 232. Updates to the filter coefficients may adjust generation of the anti-noise signal 210 to optimize cancellation of the undesired noise x(n) resulting in generation of one or more quiet zones.

FIG. 3 is an example ANC system 300 implemented in an example vehicle 302. The ANC system 300 may be configured to reduce or eliminate undesired sounds associated with the vehicle 302. In one example, the undesired sound may be engine noise 303 (represented in FIG. 3 as a dashed arrow) associated with an engine 304. However, various undesired sounds may be targeted for reduction or elimination such as road noise or any other undesired sound associated with the vehicle 302. The engine noise 303 may be detected through at least one sensor 306. In one example, the sensor 306 may be an accelerometer, which may generate a noise signal 308 based on a current operating condition of the engine 304 indicative of the level of the engine noise 303. Other manners of sound detection may be implemented, such as microphones or any other sensors suitable to detect audible sounds associated with the vehicle 302. The noise signal 308 may be transmitted to the ANC system 300.

The vehicle 302 may contain various audio/video components. In FIG. 3, the vehicle 302 is shown as including an audio system 310, which may include various functionality or devices for providing audio/visual information, such as an AM/FM radio, a CD/DVD player, a mobile phone, a navigation system, an MP3 player, or a personal music player interface. The audio system 310 may be embedded in a dash board 311 included in the vehicle 302. The audio system 310 may also be configured for mono operation, stereo operation, 5-channel operation, 5.1 channel operation, 6.1 channel operation, 7.1 channel operation, or any other audio channel output configuration. The audio system 310 may include a plurality of speakers in the vehicle 302. The audio system 310 may also include other components, such as an amplifier (not shown), which may be disposed at various locations within the vehicle 302 such as a trunk 313 included in the vehicle 302.

In one example, the vehicle 302 may include a plurality of speakers, such as a left rear speaker 326 and a right rear speaker 328, which may be positioned on or within a rear shelf 320. The vehicle 302 may also include a left side speaker 322 and a right side speaker 324, each mounted in a predetermined location, such as within a respective rear vehicle door. The vehicle 302 may also include a left front speaker 330 and a right front speaker 332, each mounted in a predetermined location, such as within a respective front vehicle door. The vehicle 302 may also include a center speaker 338 in a predetermined positioned such as within the dashboard 311. In other examples, other configurations of the audio system 310 in the vehicle 302 are possible.

In one example, the center speaker 338 may be used to transmit anti-noise to reduce engine noise that may be heard in a quiet zone 342, or listening region, within a listening area formed by the passenger cabin of the vehicle 302. In this example, the quiet zone 342 may be an area proximate to a driver's ears, which may be proximate to a driver's seat head rest 346 of a driver seat 347. In FIG. 3, a sensor such as a microphone 344, or any other mechanism for sensing sound waves, may be disposed in or adjacent to the head rest 346. The microphone 344 may be connected to the ANC system 300 and provide an input signal. In FIG. 3, the ANC system 300 and audio system 310 are connected to the center speaker 338, so that signals generated by the audio system 310 and the ANC system 300 may be combined to drive center speaker 338 and produce a speaker output 350 (represented as dashed arrows). This speaker output 350 may be produced as a sound wave so that the anti-noise destructively interferes with the engine noise 303 in the quiet zone 342. One or more other speakers in the vehicle 302 may be selected to produce a sound wave that also includes anti-noise to create one or more other quiet zones or support the quiet zone 342. Furthermore, additional microphones 344 may be placed at various positions throughout the vehicle 302 to support creation of one or more additional desired quiet zones within the listening area and/or to support the quiet zone 342.

Figure 4:
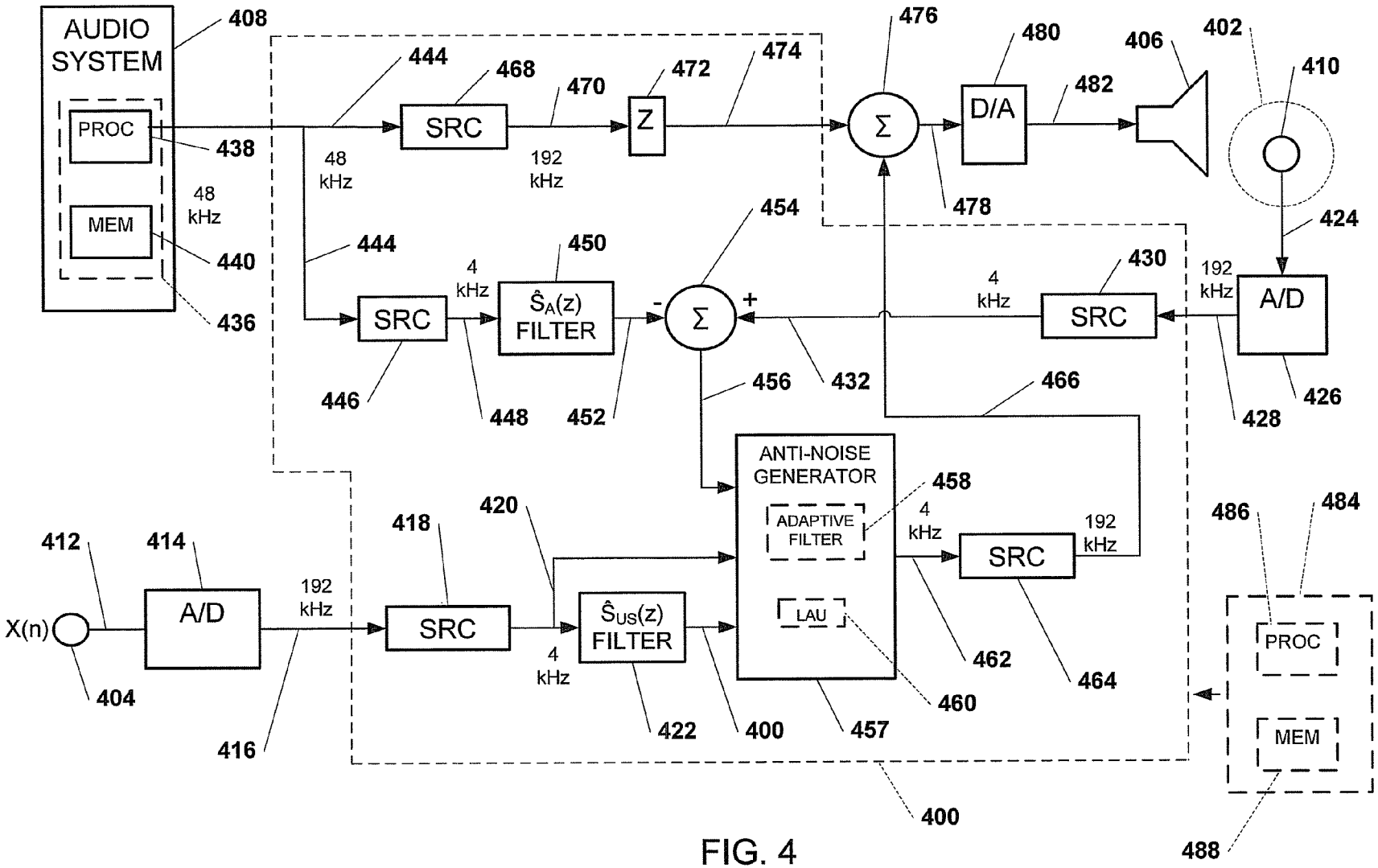
FIG. 4 is an example of a system implementing an ANC system.

In FIG. 4, an example of an ANC system 400 with audio compensation is shown as a single-channel implementation. In one example, the ANC system 400 may be used in a vehicle, such as the vehicle 302 of FIG. 3. Similar to that described in regard to FIGS. 1 and 2, the ANC system 400 may be configured to generate anti-noise to eliminate or reduce an undesired noise in a quiet zone 402. The anti-noise may be generated in response to detection of an undesired noise through a sensor 404. The ANC system 400 may generate anti-noise to be transmitted through a speaker 406. The speaker 406 may also transmit an audio signal produced by an audio system 408. A microphone 410 may be positioned in the quiet zone 402 to receive output from the speaker 406. The input signal of the microphone 410 may be compensated for presence of a signal representative of an audio signal generated by the audio system 408. After removal of the signal component, a remaining signal may be used as an input to the ANC system 400. Alternatively, the input signal of the microphone 410 may be used as an input to the ANC system 400.

In FIG. 4, the sensor 404 may generate an output 412 received by an A/D converter 414. The A/D converter 414 may digitize the sensor output 412 at a predetermined sample rate. A digitized undesired sound signal 416 of the A/D converter 414 may be provided to a sample rate conversion (SRC) filter 418. The SRC filter 418 may filter the digitized undesired sound signal 416 to adjust the sample rate of the undesired sound signal 416. The SRC filter 418 may output the filtered undesired sound signal 420, which may be provided to the ANC system 400 as an input. The undesired sound signal 420 may also be provided to an undesired sound estimated path filter 422. The estimated path filter 422 may simulate the effect on the undesired sound of traversing from the speaker 406 to the quiet zone 402. The filter 422 is represented as a Z-domain transfer function $\hat{S}_{US}(z)$.

As previously discussed, the microphone 410 may detect a sound wave and generate an input signal 424 that includes both an audio signal and any signal remaining from destructive interference between undesired noise and the sound wave output of the speaker 406. The microphone input signal 424 may be digitized through an A/D converter 426 having an output signal 428 at a predetermined sample rate. The digitized microphone input signal 428 may be provided to an SRC filter 430 which may filter the digitized microphone input signal 428 to change the sample rate. Thus, output signal 432 of the SRC filter 430 may be the filtered microphone input signal 428. The output signal 432 may be further processed as described later.

In FIG. 4, the audio system 408 may generate an audio signal 444. The audio system 408 may include a digital signal processor (DSP) 436. The audio system 408 may also include a processor 438 and a memory 440. The audio system 408 may process audio data to provide the audio signal 444. The audio signal 444 may be at a predetermined sample rate. The audio signal 444 may be provided to a SRC filter 446, which may filter the audio signal 444 to produce an output signal 448 that is an adjusted sample rate version of the audio signal 444. The output signal 448 may be filtered by an estimated audio path filter 450, represented by Z-domain transfer function $\hat{S}_A(Z)$. The filter 450 may simulate the effect on the audio signal 444 transmitted from the audio system 408 through the speaker 406 to the microphone 410. An audio compensation signal 452 represents an estimate of the state of the audio signal 444 after the audio signal 444 traverses a physical path to the microphone 410. The audio compensation signal 452 may be combined with the microphone input signal 432 at summer 454 to remove a component from the microphone input signal 432 representative of audio signal component 444.

An error signal 456 may represent a signal that is the result of destructive interference between anti-noise and undesired sound in the quiet zone 402 absent the sound waves based on an audio signal. The ANC system 400 may include an anti-noise generator 457 that includes an adaptive filter 458 and an LAU 460, which may be implemented to generate an anti-noise signal 462 in a manner as described in regard to FIG. 2.

The anti-noise signal 462 may be generated at a predetermined sample rate. The signal 462 may be provided to a SRC filter 464, which may filter the signal 462 to adjust the sample rate. The sample rate adjusted filter signal may be provided as output signal 466.

The audio signal 444 may also be provided to an SRC filter 468, which may adjust the sample rate of the audio signal 444. Output signal 470 of the SRC filter 468 may represent the audio signal 444 at a different sample rate. The audio signal 470 may be provided to a delay filter 472. The delay filter 472 may be a time delay of the audio signal 470 to allow the ANC system 400 to generate anti-noise such that the audio signal 452 is synchronized with output from the speaker 406 received by the microphone 410. Output signal 474 of the delay filter 472 may be summed with the anti-noise signal 466 at a summer 476. The combined signal 478 may be provided to a digital-to-analog (D/A) converter 480. Output signal 482 of the D/A converter 480 may be provided to the speaker 406, which may include an amplifier (not shown), for production of sound waves that propagate into the quiet zone 402.

In one example, the ANC system 400 may be instructions stored on a memory executable by a processor. For example, the ANC system 400 may be instructions stored on the memory 440 and executed by the processor 438 of the audio system 408. In another example, the ANC system 400 may be instructions stored on a memory 488 of a computer device 484 and executed by a processor 486 of the computer device 484. In other examples, various features of the ANC system 400 may be stored as instructions on different memories and executed on different processors in whole or in part. The memories 440 and 488 may each be computer-readable storage media or memories, such as a cache, buffer, RAM, ROM, removable media, hard drive or other computer readable storage media. Computer readable storage media may include one or more of various types of volatile and nonvolatile storage media. Various processing techniques may be implemented by the processors 438 and 486 such as multiprocessing, multitasking, parallel processing and the like, for example.

Figure 5:
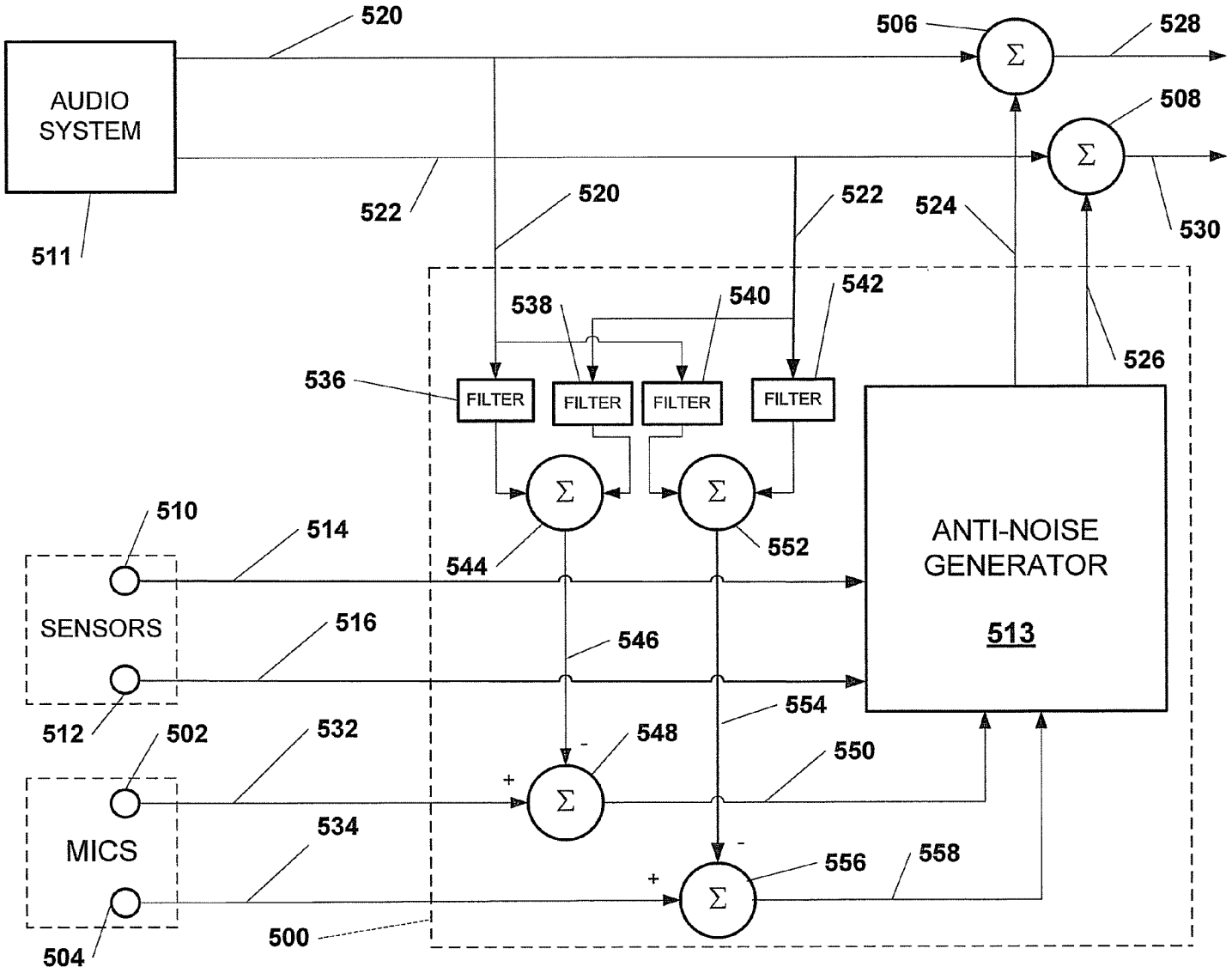
FIG. 5 is an example of a multi-channel implementation of an ANC system.

FIG. 5 is a block diagram of an example ANC system 500 that may be configured for a multi-channel system. The multi-channel system may allow for a plurality of microphones and speakers to be used to provide anti-noise to one or more quiet zones. As the number of microphones and speakers increase, the number of physical paths and corresponding estimated path filters grows exponentially. For example, FIG. 5 shows an example of an ANC system 500 configured to be used with a first microphone 502 and a second microphone 504 and a first speaker 506 and a second speaker 508 (illustrated as summation operations), as well as a first reference sensor 510 and a second reference sensor 512. The reference sensors 510 and 512 may be configured to each detect an undesired sound or some other parameter representative of an undesired sound. The reference sensors 510 and 512 may provide detection representative of two different sounds or the same sound. Each of the reference sensors 510 and 512 may generate a signal 514 and 516, respectively, indicative of the respective detected undesired sound. Each of the signals 514 and 516 may be transmitted to an anti-noise generator 513 of the ANC system 500 to be used as inputs by the ANC system 500 to generate anti-noise.

An audio system 511 may be configured to generate a first audio signal on a first audio channel 520 and a second audio signal on a second audio channel 522. In other examples, any other number of separate and independent channels, such as five, six, or seven channels, may be generated by the audio system 511 to drive loudspeakers. The first audio signal on the first audio channel 520 may be provided to the first speaker 506 and the second audio signal on the second audio channel 522 may be provided to second speaker 508. The anti-noise generator 513 may generate a first anti-noise signal 524 and a second anti-noise signal 526. The first anti-noise signal 524 may be combined with the first audio signal on the first audio channel 520 so that both signals are transmitted as a first sound wave speaker output 528 generated with the first speaker 506. Similarly, the second audio signal on the second audio channel 522 and the second anti-noise signal 526 may be combined so that both signals may be transmitted as a second sound wave speaker output 530 generated with the second speaker 508. In other examples, only one anti-noise signal may be transmitted to one or both the first and second speakers 506 or 508.

Microphones 502 and 504 may receive sound waves that include the sound waves output as the first and second sound wave speaker outputs 528 and 530. The microphones 502 and 504 may each generate a microphone input signal 532 and 534, respectively. The microphone input signals 532 and 534 may each indicate sound received by a respective microphone 502 and 504, which may include an undesired sound and the audio signals. A component representative of an audio signal may be removed from a microphone input signal. In FIG. 5, each microphone 502 and 504 may receive sound wave speaker outputs 528 and 530, as well as any targeted undesired sounds. Thus, components representative of the audio signals associated with each of the sound wave speaker outputs 528 and 530 may be removed from the each of the microphone input signals 532 and 534.

In FIG. 5, each of the first audio signal on the first audio channel 520 and the second audio signal on the second audio channel 522 is filtered by an estimated audio path filter. The first audio signal on the first audio channel 520 may be filtered by a first estimated audio path filter 536. The first estimated audio path filter 536 may represent the estimated physical path (including components, physical space, and signal processing) of the first audio signal from the audio system 511 to the first microphone 502. The second audio signal on the second audio channel 522 may be filtered by a second estimated audio path filter 538. The second estimated audio path filter 538 may represent the estimated physical path of the second audio signal from the audio system 511 to the second microphone 502. The filtered signals may be summed at summation operation 544 to form a first combined audio signal 546. The first combined audio signal 546 may be used to eliminate a similar signal component present in the first microphone input signal 532 at a summing operation 548. The resulting signal is a first error signal 550, which may be provided to the anti-noise generator 513 to generate the first anti-noise signal 524 associated with an undesired sound detected by the first sensor 510. Alternatively, or in addition, the first error signal 550 may be used by the anti-noise generator 513 to generate the second anti-noise signal 526, or both the first anti-noise signal 526 and the second anti-noise signal 526 in accordance with the position of the first and second microphones 510 and 512 with respect to the first and second speakers 506 and 508. In other examples, the first and second estimated path filters 536 and 540, the summation operation 544 and the summing operation 548 may be omitted and the first microphone signal 532 may be provided as the first error signal 550 to the anti-noise generator 513.

Similarly, the first and second audio signals on the first and second audio channels 520 and 522, respectively, may be filtered by third and fourth estimated audio path filters 540 and 542, respectively. The third estimated audio path filter 540 may represent the physical path traversed by the first audio signal of the first audio channel 520 from the audio system 511 to the second microphone 504. The fourth estimated audio path filter 542 may represent the physical path traversed by the second audio signal of the second audio channel 522 from the audio system 511 to the second microphone 504. The first and second audio signals may be summed together at summation operation 552 to form a second combined audio signal 554. The second combined audio signal 554 may be used to remove a similar signal component present in the second microphone input signal 534 at operation 556, which results in a second error signal 558. The error signal 558 may be provided to the ANC system 500 to generate an anti-noise signal 526 associated with an undesired sound detected by the sensor 504.

The estimated audio path filters 536, 538, 540, and 542 may be determined by learning the actual paths. As the number of reference sensors and microphones increases, additional estimated audio path filters may be implemented in order to eliminate audio signals from microphone input signals to generate error signals that allow the ANC system to generate sound cancellation signals based on the error signals to destructively interfere with one or more undesired sounds.

Figure 6:
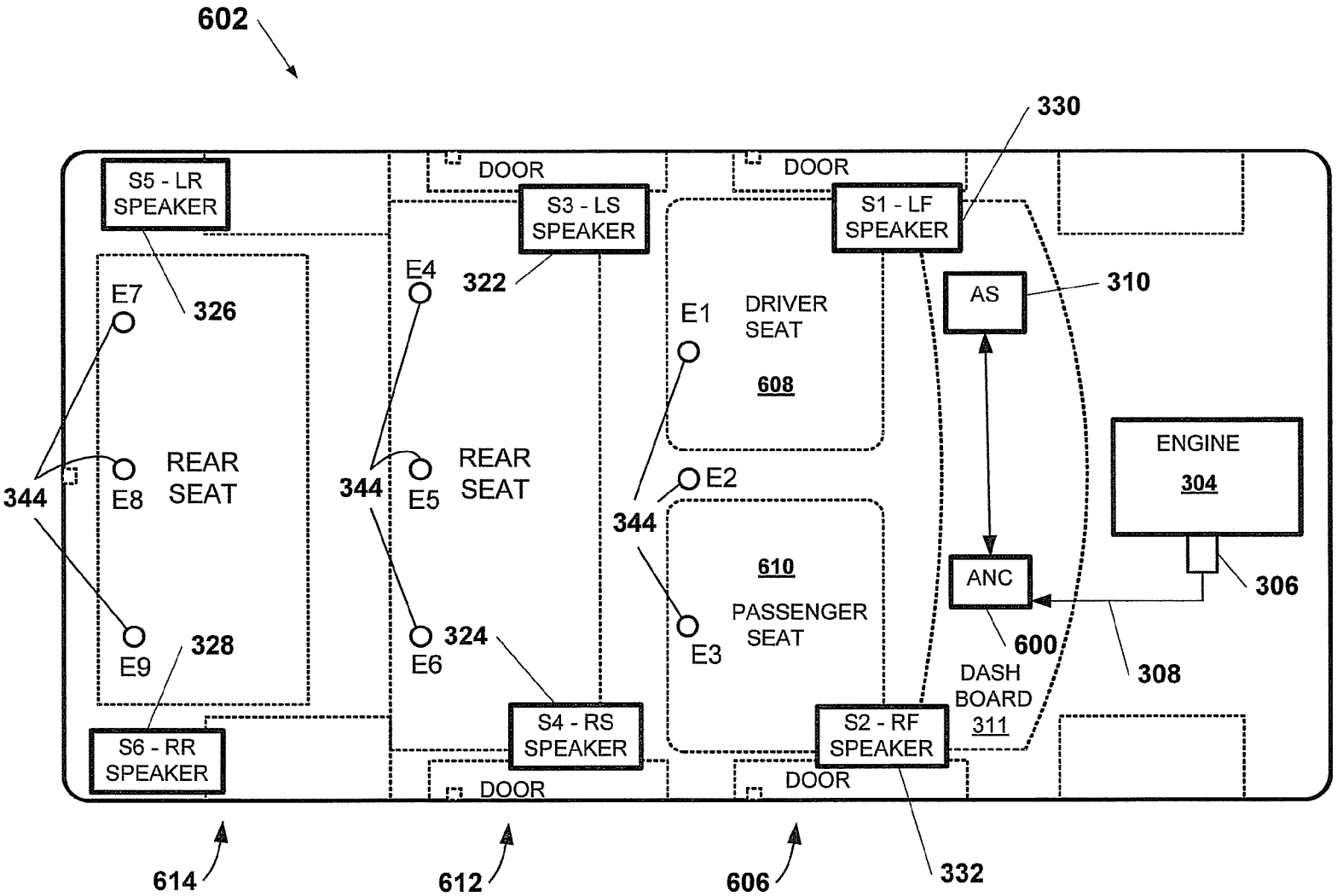
FIG. 6 is a top view of another example vehicle implementing an ANC system.

FIG. 6 is another example ANC system 600 that may be implemented in an example vehicle 602 to substantially cancel (e.g. reduce by 3dB down or more, or minimize perception by a listener) undesired sounds, such as undesired sounds associated with operation of the vehicle 602. In one example, the undesired sound may be the engine noise as previously discussed with reference to FIG. 3. In other examples, any other undesired sound or sounds may be targeted for reduction or elimination, such as road noise, fan noise or any other undesired sound or sounds associated with the vehicle 602.

In FIG. 6, a passenger cabin included in the vehicle 602 includes a first row of seating 606 that includes a driver seat 608, and a front passenger seat 610, a second row of seating 612 that includes accommodations for one or more passengers, and a third row of seating 614 that includes accommodations for one or more passengers. In other examples, additional or fewer rows of seating may be included in the passenger cabin. The vehicle 602 also includes an audio system 310 and a plurality of speakers (S1-S6). In FIG. 6, there is a left side speaker (S3) 322, a right side speaker (S4) 324, a left rear speaker (S5) 326, a right rear speaker (S6) 328, a left front speaker(S1) 330, and a right front speaker (S2) 332. In other examples, fewer or greater numbers of speakers may be included.

Each of the first row of seating 606, the second row of seating 612 and the third row of seating 614 may be considered a listening zone or listening region within the listening area formed by the passenger cabin. Sensors, such as audio microphones 344 providing error signals for the ANC system 600, may be included in each of the listening areas. In FIG. 6 each passenger seat in the vehicle 602 includes an audio microphone 344 (E1-E9) that may be positioned in a headrest, seatback, or in the ceiling above the passenger seat. In other examples, any number of audio microphones 344 in any location proximate to or within the listening areas may be used.

Figure 7:
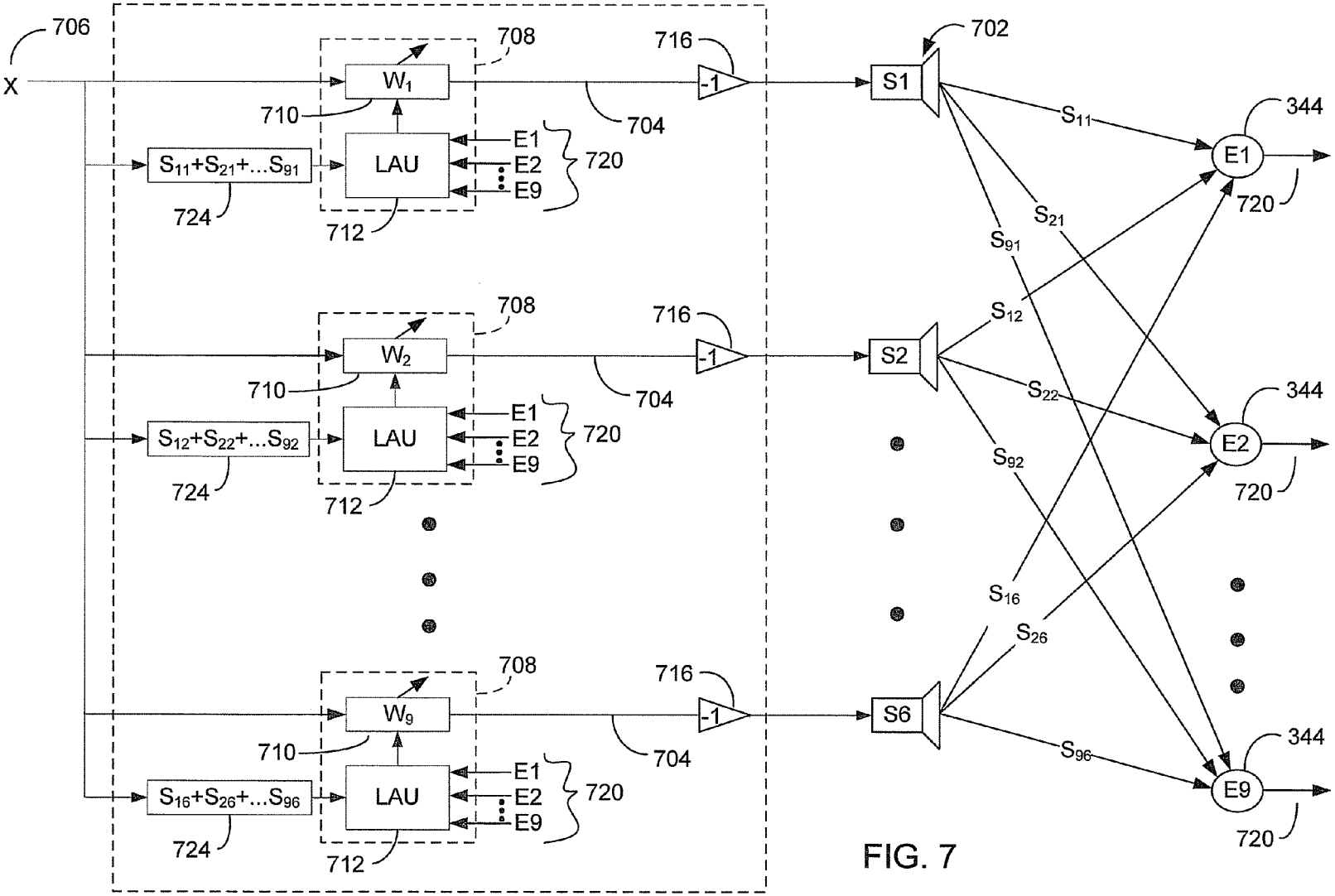
FIG. 7 is a block diagram of an example configuration implementing the ANC system of FIG. 6.

FIG. 7 is an example block diagram generally representing a system configuration implementing the ANC system 600 of FIG. 6. In FIG. 7, the speakers (S1-S6) 322, 324, 326, 328, 330 and 332 (or any other (n) number of speakers) in the vehicle 602 that may be used to generate anti-noise sound waves are identified generally as 702. Any of the speakers 702 may be independently driven by separate anti-noise signals generated with the ANC system 600 on anti-noise signal lines 704 based on at least one undesired sound (x) 706. Between each of the (n) audio microphones 344 (E1-E9) and each of the (n) speakers 702 (S1-S6) emitting anti-noise sound waves, a portion of a physical path exists over which the anti-noise waves travel. In FIG. 7, each portion of the physical path is represented as "$S_{ab}$" where "a" is representative of the particular sensor and "b" is representative of the speaker 702 included in a given physical path. The physical path may also include electronics, such as A/D converters, amplifiers, and the like. In the example of FIG. 7, all of the speakers 702 are configured to emit anti-noise sound waves. In other examples, fewer than all of the speakers 702 may be driven by a respective anti-noise signal.

Within the ANC system 600, each of the anti-noise signals on the anti-noise signal lines 704 may be generated with a respective anti-noise generator 708 that includes a respective independent adaptive filter ($W_n$) 710 and a learning algorithm unit (LAU) 712. Anti-noise signals generated with the anti-noise generators 708 may be inverted with inverters 716 and provided to the speakers 702. The audio microphones 344 may produce error signals that are supplied to each LAU 712 on an error signal line 720. The error signals may include any portion of the undesired sound (x) 706 that has not been canceled by the anti-noise sound waves generated with the speakers 702. In other examples, if an audio system is present and operating to generate desirable audio signals, the desirable audio signals may be removed from the error signals as previously discussed.

The undesired sound (x) 706 may also be supplied to the respective adaptive filters ($W_n$) 710 and to respective estimated path filters 724 associated with each of the anti-noise generators 708. Alternatively, or in addition, the undesired sound (x) 706 may be generated with the ANC system 600 as a simulation of an undesired sound.

During operation, each learning algorithm unit (LAU) 712 may calculate an update to the coefficients of the respective adaptive filter ($W_n$) 710. For example, calculation of a next iteration of the coefficients $W_1^{k+1}$ for a first adaptive filter 710 generating anti-noise signals for a first speaker 702, such as the left front speaker 330 is:

$$W_1^{k+1} = W_1^k + \mu \begin{bmatrix} we_1(fx_{11}e_1 + fx_{21}e_2 + fx_{31}e_3) + \\ we_2(fx_{41}e_4 + fx_{51}e_5 + fx_{61}e_6) + \\ we_3(fx_{71}e_7 + fx_{81}e_8 + fx_{91}e_9) \end{bmatrix} \quad \text{(Eq. 1)}$$

where $W_1^k$ is a current iteration of the coefficients of the first adaptive filter 710, μ is a predetermined system specific constant chosen to control the speed of change of the coefficients in order to maintain stability, $we_c$ is a weighting factor or weighting error, $fx_{ab}$ is an estimate of the filtered undesired noise provided with a respective first estimated path filter 724, and $e_n$ is the error signal from the respective audio microphone 344.

The estimate of the filtered undesired noise $fx_{ab}$ is an estimate of the undesired noise experienced at a respective one of the audio microphones 344 and can also be described as a predetermined estimated secondary path transfer function convolved with the undesired noise (x) 706. For example, in the example of FIG. 6, $fx_{ab}$ may be:

$$\begin{vmatrix} fx_{11} fx_{12} \ldots fx_{19} \\ fx_{21} fx_{22} \ldots fx_{29} \\ \vdots \\ \vdots \\ fx_{91} fx_{92} \ldots fx_{99} \end{vmatrix} = \begin{vmatrix} s_{11} s_{12} \ldots s_{19} \\ s_{21} s_{22} \ldots s_{29} \\ \vdots \\ \vdots \\ s_{91} s_{92} \ldots s_{99} \end{vmatrix} \otimes \begin{vmatrix} x \\ x \\ \vdots \\ \vdots \\ x \end{vmatrix} \quad \text{(Eq. 2)}$$

Where $s_{11}s_{12} \ldots s_{19}$ through $s_{91}s_{92} \ldots s_{99}$ are representative of the estimated secondary path transfer functions for each of the available physical paths, and undesired noise (x) 706 is a vector.

In Equation 1, a filter adjustment to minimize undesired sound in each listening region is represented with the combination of one or more error signals $e_n$ from respective audio microphones 344 in the respective listening region and the corresponding estimated filtered undesired noise $fx_{ab}$ signal for each estimated secondary path in the respective listening region. For example, $(fx_{11}e_1+fx_{21}e_2+fx_{31}e_3)$ is representative of a filter adjustment to minimize undesired sound in the listening region of the first row of seats 606, $(fx_{41}e_4+fx_{51}e_5+fx_{61}e_6)$ is representative of a filter adjustment for the listening region of the second row of seats 612, and $(fx_{71}e_7+f_{81}e_8+fx_{91}e_9)$ is representative of a filter adjustment for the listening region of the third row of seats 614.

The amount of filter adjustment, or influence on the filter adjustment of the error from each of the listening regions for a particular adaptive filter $(W_n)$ 710 is based on the weighting factors $(we_1, we_2, we_3)$. Accordingly, the weighting factors $(we_1, we_2, we_3)$ may provide adjustment of the location and size of a respective quiet zone formed by destructive combination of the anti-noise sound waves generated with a respective adaptive filter $(W_n)$ 710 and an undesired sound. Adjustment of the weighting factors $(we_1, we_2, we_3)$ adjusts the amount of filter adjustment, or group of filter adjustments, used to update the coefficients of a respective adaptive filter $(W_n)$ 710. In other words, adjustment of the weighting factors $(we_1, we_2, we_3)$ adjusts the impact of the combination of error $(e_n)$ and a corresponding estimated filtered undesired noise signal $(fx_{ab})$, or a group of errors and corresponding filtered estimated undesired noise signals, in a respective listening region, that are used to update the coefficients of a respective adaptive filter $(W_n)$ 710. Each of the adaptive filters $(W_n)$ 710 may provide an anti-noise signal to independently generate a quiet zone, groups of adaptive filters $(W_n)$ 710 may each cooperatively operate to generate a respective single quiet zone, or all of the adaptive filters $(W_n)$ 710 may cooperatively operate to generate a single quiet zone.

For example, in FIG. 7, when the weighting factors $(we_1, we_2, we_3)$ are all set equal to one (=1), the area of the quiet zone may include all the listening regions represented with the first second and third rows of seats, 606, 612 and 614, respectively. In another example, when it is desired to form a quiet zone that includes only the first row of seats 606, the first weighting factor $we_1$ may be set equal to one (=1), the second weighting factor $we_2$ may be set equal to 0.83, and the third weighting factor $we_3$ may be set equal to 0.2. Thus, by adjusting the weighting factors $(we_1, we_2, we_3)$, the size and shape of a corresponding quiet zone may be adjusted to reside within a desired area within the listening space that may include less than all of the listening regions in the listening area.

In other words, in the example of a quiet zone formed within the first row of seats 606, error signals from the audio microphones 344 and corresponding estimated filtered undesired noise values in the listening regions represented with the second row of seats 612 and the third row of seats that are not included in the quiet zone are still considered in adapting the filter coefficients of the adaptive filter $(W_n)$ 710 to form the quiet zone in the first row of seats 606. Since each of the adaptive filters $(W_n)$ 710 generating an anti-noise signal for a respective speaker 702 may include weighting factors, each respective anti-noise signal may be updated based on error signals and estimated filtered undesired noise values that are not included within a respective quiet zone generated with the anti-noise signal.

Each LAU 712 may perform Equations 1 and 2 to determine an update value for each adaptive filter $(W_1^{k+1}, W_2^{k+1}, W_3^{k+1}, \ldots W_n^{k+1})$ 710 to drive each respective loudspeaker 702, such as speakers 322, 324, 326, 328, 330 and 332. Depending on the weighting factors used, a first quiet zone generated based on a first adaptive filter $(W_1)$ 710 and corresponding speaker 702 may be substantially the same area and overlapping with a second quiet zone generated based on a second adaptive filter $(W_2)$ 710 and corresponding speaker 702. In another example, the first quiet zone may overlap a portion of one or more other quiet zones, or the first quiet zone may be one of a number of separate and distinct quiet zones within the listening area that do not have overlapping coverage areas. Accordingly, in addition to a single quiet zone large enough to include all three rows of seats 606, 612 and 614 based on all the weighting factors $(we_1, we_2, we_3)$ being equal to one (=1), in other examples, a first quiet zone may include the first row of seats 606 and a second quiet zone may include only the second row of seats 612 and/or the third row of seats 614. In other examples, any number and size of quiet zones may be created based on the number of adaptive filters $(W_n)$ 710 and corresponding weighting factors applied to each respective adaptive filter $(W_n)$ 710.

In the example of Equation 1, error signals and corresponding estimated filtered undesired noise signals from each of the listening regions (first, second and third rows of seats 606, 612 and 614) are grouped according to association with a listening region to form a filter adjustment. A weighting factor $(we_1, we_2, we_3)$ is applied to the group to establish the size and location (area) of one or more corresponding quiet zones. In other examples, a separate weighting factor may be applied to each of the error signals and corresponding estimated filtered undesired noise signals to tailor the size and location of one or more corresponding quiet zones. In still other examples, a combination of individual weighting factors $ve_n$ and group weighting factors $we_n$ may be applied to the error signals and corresponding estimated filtered undesired noise signals in a respective one of the adaptive filters $(W_1)$ 710 to establish one or more corresponding quiet zones:

$$W_1^{k+1} = W_1^k + \mu \begin{bmatrix} we_1(fx_{11}e_1ve_1 + fx_{21}e_2ve_1 + fx_{31}e_3ve_1) + \\ we_2(fx_{41}e_4ve_1 + fx_{51}e_5ve_1 + fx_{61}e_6ve_1) + \\ we_3(fx_{71}e_7ve_1 + fx_{81}e_8ve_1 + fx_{91}e_9ve_1) \end{bmatrix} \quad \text{(Eq. 3)}$$

Accordingly, in one example, weighting factors may be applied to establish a first quiet zone for the driver seat position in the first row of seats 606, and a second quiet zone may be created with the weighting factors for a baby car seat positioned in the center seat position in the second row of seats 612.

In one configuration the weighting factors for each of the adaptive filters $(W_n)$ 710 may be manually set to predetermined values to create one or more static and non-changing quiet zones. In another configuration of the ANC system 600, the weighting factors may be dynamically adjusted. Dynamic adjustment of the weighting factors may be based on parameters external to the ANC system 600, or parameters within ANC system 600.

In one example implementing dynamically adjustable weighting factors, seat sensors, head and facial recognition, or any other seat occupancy detection techniques may be used to provide an indication when seats within the listening regions are occupied. A database, a lookup table, or a weighting factor calculator may be used to dynamically adjust the weighting factors in accordance with the detected occupancy within the listening regions to provide automated zonal configuration of one or more quiet zones. In one example, the individual weighting factors $ve_n$ may be set to a zero or a one depending on seating occupancy. In another example, the individual weighting factors $ve_n$ may be set to some value between zero and infinity based on, for example, subjective or objective analysis, cabin geometry, or any other variables affecting the location and area of a corresponding quiet zone.

In another example, a user of the ANC system 600 may manually select to implement one or more quiet zones within the vehicle 602. In this example, the user may access a user interface, such as a graphical user interface, to set one or more quiet zones in the vehicle 602. Within the graphical user interface the user may implement a tool, such as a grid based tool superimposed over a representation of the interior of the vehicle, to set an area for each of one or more desired quiet zones. Each of the quiet zones may be identified with a user selectable geometric shape, such as a circle, square, or rectangle that the user can vary in size and shape. Accordingly, for example, a user selected circle may be increased or decreased in size and stretched or compressed to form an oval. Once the user selects one or more quiet zones, and the shape of the quiet zones, the ANC system 600 may select the proper weighting factors for the respective adaptive filters ($W_n$) 710 to generate the one or more quiet zones. Selection of the weighting factors may be based on accessing predetermined values stored in a storage location such as a database or a lookup table, or calculation of the weighting factors by the ANC system 600 based on the size and shape of the selected quiet zone(s). In another example, a user may select or "turn on" different predetermined quiet zones, drag and drop predetermined quiet zones, select areas of the vehicle for inclusion in a quiet zone or perform any other activity indicating a desired location and area of one or more quiet zones in the vehicle 602.

The ANC system 600 may also analyze an effectiveness of a current weighting factor configuration forming a quiet zone and dynamically adjust the weighting factors to optimize the selected quiet zones. For example, if a speaker 702 is temporarily blocked by an item, such as a bag of groceries, anti-noise sound waves generated by the blocked speaker 702 may not be as effective at destructively combining with the undesired sound. The ANC system 600 may gradually change selected weighting factors to increase the magnitude of anti-noise sound waves generated from one or more other speakers 702 to compensate. The change in the weighting factors may be incrementally small enough to avoid perception by listeners within the respective quiet zone. Such changes may also be performed based on consideration of the previously discussed occupancy detection.

In one example, the ANC system 600 may include redundantly operating anti-noise generators that receive the same sensor signals and errors signals. A first anti-noise generator may generate anti-noise signals to drive the speakers 702, while a second anti-noise generator may operate in the background to optimize the reduction in the undesired noise within a respective quiet zone. The second anti-noise generator may drive down the depth of one or more simulated quiet zones that are analogous to the actual quiet zones created with the first anti-noise generator. The second anti-noise generator may significantly adjust the individual weighting factors $ve_n$ and group weighting factors $we_{n2}$ through a series of iterations to minimize error in the simulated one or more quiet zones without subjecting the listener to perception of such significant adjustments and iterations.

For example, anti-noise sound waves generated from one speaker 702 may be shifted to another speaker 702 in an effort to obtain better destructive combination between anti-noise sound waves and undesired sound within the desired quiet zone(s). Once the depth of the one or more simulated quiet zones have been optimized with the second anti-noise generator, the weighting factors in the first anti-noise generator may be adjusted to match the weighting factors in the second anti-noise generator in such a way to minimize perception of any change by a listener present in the quiet zone created by the first anti-noise generator.

The ANC system 600 may also include a diagnostic capability to confirm proper operation. During diagnostics, the ANC system 600 may decouple the system to focus on each of a number of single audio microphone 344 and speaker 702 combinations. The ANC system 600 may iteratively adjust the anti-noise signal and confirm that the error signal is not diverging. In the event a speaker 702 or audio microphone 344 is determined to be improperly operating, the identified speaker 702 or audio microphone 344 may be decoupled from the ANC system 600. Diagnostics may be performed by the ANC system 600 during startup, or at a predetermined time, such as when the vehicle 602 is parked and unoccupied. Any malfunctioning hardware may be identified by the ANC system 600 with an error message indicating the specific speaker 702 and/or audio microphone 344 identified to be malfunctioning. The ANC system 600 may also automatically disable any audio microphone 344 or speaker 702 identified as disabled.

Figure 8:
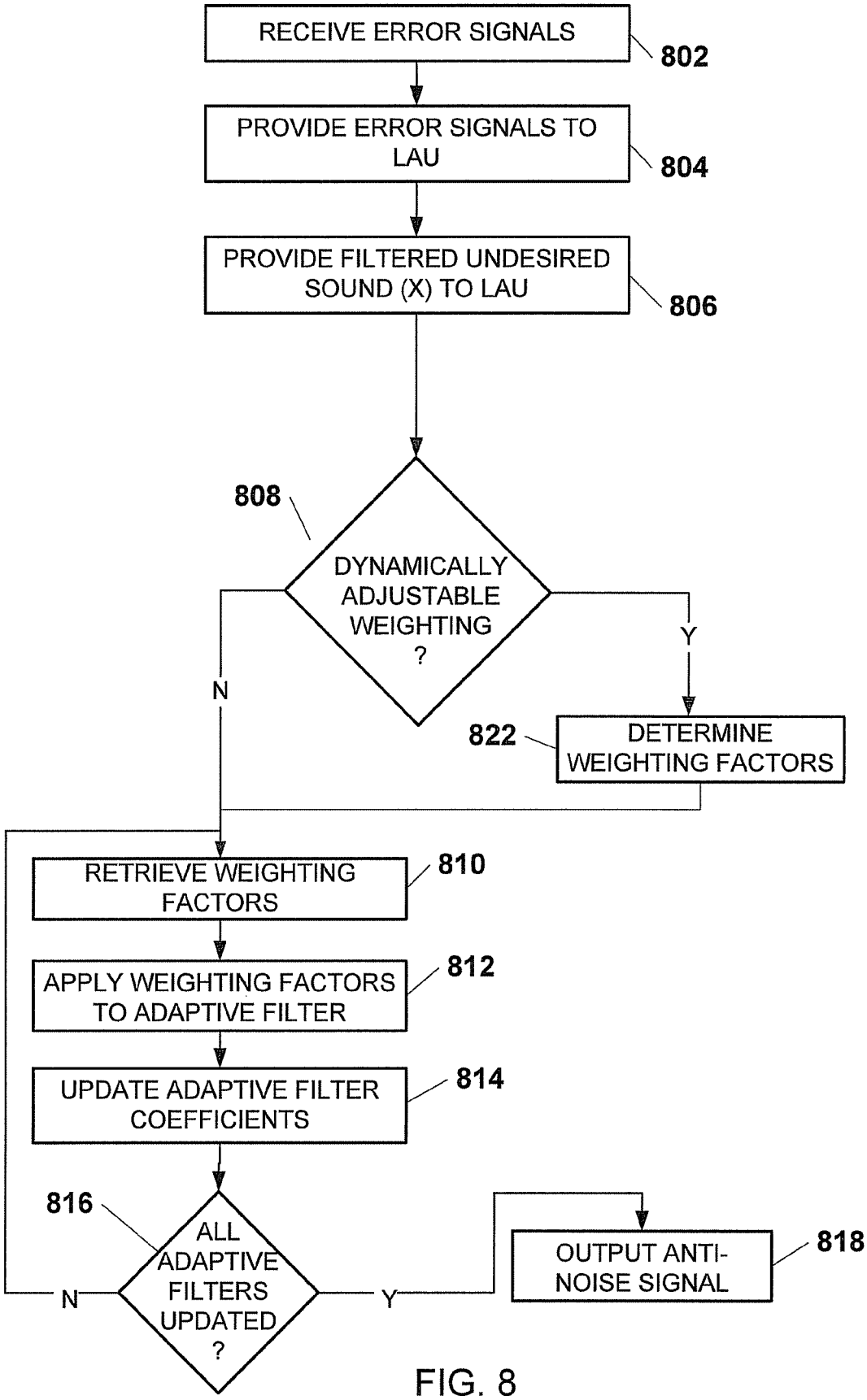
FIG. 8 is an example operational flow diagram of the ANC system of FIG. 6.

FIG. 8 is an example flow diagram illustrating operation of the ANC system 600 in the vehicle 602 with reference to FIGS. 6 and 7. In the example operation, the physical paths that include the speakers 702 emitting the anti-noise sound waves and the audio microphones 344 have already been established and stored for each of the anti-noise generators 708. In addition, an initial value for each of the adaptive filters ($W_n$) 710 exists. The operation begins at block 802 upon receipt by the ANC system 600 of a plurality (n) of discrete error signals from a listening area that includes a first error signal from a first listening region and a second error signal from a second listening region. The error signals are indicative of the presence of an undesired sound (x) 706 included in the listening area. At block 804 the error signals 720 are provided to each of the LAU's 712. In addition, the undesired sound (x) 706 that has been filtered by a respective estimated secondary path filter 724 is provided to each of the LAU's 712 at block 806.

In block 808, it is determined if the weighting factors are dynamically adjustable. If the weighting factors are not dynamically adjustable, in other words, one or more quiet zones within the listening area are static, the weighting factors are retrieved at block 810. At block 812, the respective weighting factors are applied to the error signals 720 and the respective filtered estimated undesired sound signals for each of the listening regions for a particular adaptive filter ($W_n$) 710 (Eq. 1). In other words, as detailed in Eq. 1, a filter adjustment value is calculated for each of the listening regions within the listening area from the error signals 720 and the respective filtered estimated undesired sound signals, and the respective weighting factors are applied to each filter adjustment value of a corresponding listening region. The coefficients of the particular adaptive filter ($W_n$) 710 are updated or adapted at block 814. At block 816 it is determined if all of the adaptive filters in the ANC system 600 have been updated. If no, the operation returns to block 810 to apply weighting factors and update the filter coefficients of another adaptive filter ($W_n$) 710. If all the adaptive filters ($W_n$) 710 have been updated, the operation proceeds to block 818 where each of the adaptive filters ($W_n$) 710 output a respective anti-noise signal to drive a corresponding speaker 702 to generate anti-noise.

Returning to block 808, if it is determined that the weighting factors are dynamically adjustable, the ANC system 600 determines the weighting factors based on occupancy, user settings or some other internal or external parameters at block 822. The operation then proceeds to block 810 for retrieval and application of the weighting factors.

The previously described ANC system provides the capability to implement multiple quiet zones in a listening space by applying weighting factors to filter update values corresponding to a number of listening regions included in the listening space. The weighted filter update values may be combined and used to update the coefficients of adaptive filters. The weighting factors may be statically applied such that the one or more quiet zones remain static. Alternatively, the weighting factors may be dynamically adjustable by the ANC system to adjust the number, size and location of the quiet zones within the listening area. The adjustment of the quiet zones via the weighting factors may be automatically performed by the ANC system based on parameters such as an occupancy determination within the listening space. In addition, or alternatively adjustment of the one or more quiet zones via the weighting factors may be based on user entered parameters.

While various embodiments of the invention have been described, it will be apparent to those of ordinary skill in the art that many more embodiments and implementations are possible within the scope of the invention. Accordingly, the invention is not to be restricted except in light of the attached claims and their equivalents.

We claim:

1. A non-transitory computer-readable medium comprising a plurality of instructions executable by a processor to create a quiet zone in a listening area, the non-transitory computer-readable medium comprising:

instructions to determine a first filter adjustment based on a first error signal indicative of an undesired sound in a first listening region included in the listening area;

instructions to determine a second filter adjustment based on a second error signal indicative of the undesired sound in a second listening region included in the listening area;

instructions to set and apply a first weighing factor to the first filter adjustment, and set and apply a second weighting factor to the second filter adjustment, the first and second weighting factors set to values selected from a plurality of non-zero incremental values; and instructions to update a set of filter coefficients of an adaptive filter based on the first weighted filter adjustment and the second weighted filter adjustment, the adaptive filter configured to generate an anti-noise signal to destructively interfere with the undesired sound to create the quiet zone.

2. The non-transitory computer-readable medium of claim 1, where at least part of the first listening region or the second listening region is outside the quiet zone.

3. The non-transitory computer-readable medium of claim 1, where the instructions executable to determine a first filter adjustment and a second filter adjustment further comprise instructions to filter the undesired noise with an estimated secondary path transfer function.

4. The non-transitory computer-readable medium of claim 1, where instructions to apply a first weighting factor to the first filter adjustment and a second weighting factor to the second filter adjustment comprise instructions to perform occupancy detection in the listening area, and instructions to retrieve the first weighting factor and the second weighting factor corresponding to the detected occupancy.

5. The non-transitory computer-readable medium of claim 1, where instructions to apply a first weighting factor to the first filter adjustment and a second weighting factor to the second filter adjustment comprise instructions to receive a signal indicative of a user-selected area for the quiet zone, and instructions to retrieve the first weighting factor and the second weighting factor that correspond to the user-selected area for the quiet zone.

6. The non-transitory computer-readable medium of claim 1, further comprising instructions to receive a plurality of discrete error signals indicative of the undesired sound present in the listening area, the discrete error signals comprising the first error signal indicative of the undesired sound in the first listening region and the second error signal indicative of the undesired sound in the second listening region.

7. A non-transitory computer-readable medium comprising a plurality of instructions executable by a processor to create a quiet zone in a listening area, the non-transitory computer-readable medium comprising:

instructions to retrieve a first set of weighting factors and a second set of weighting factors, a first location and size of a first quiet zone based on the first set of weighting factors, and a second location and size of a second quiet zone based on the second set of weighting factors, each of the first and second sets of weighting factors being different non-zero values from within range of non-zero values;

instructions to calculate a first filter adjustment based on the undesired sound and a first error signal received from a first listening region;

instructions to calculate a second filter adjustment based on the undesired sound and a second error signal received from a second listening region;

instructions to apply the first set of weighting factors to the first filter adjustment and the second filter adjustment to update a first adaptive filter, the first adaptive filter configured to generate a first anti-noise signal to destructively interfere with the undesired sound to produce the first quiet zone; and instructions to apply the second set of weighting factors to the first filter adjustment and the second filter adjustment to update a second adaptive filter, the second adaptive filter configured to generate a second anti-noise signal to destructively interfere with the undesired sound to produce the second quiet zone.

8. The non-transitory computer-readable medium of claim 7, where the instructions to apply the first set of weighting factors comprise instructions to update a first set of filter coefficients of the first adaptive filter with a first update value, the first update value generated based on application of the first set of weighting factors to the first filter adjustment and the second filter adjustment.

9. The non-transitory computer-readable medium of claim 8, where the instructions to apply the second set of weighting factors comprises instructions to update a second set of filter coefficients of the second adaptive filter with a second update value, the second update value generated by application of the second set of weighting factors to the first filter adjustment and the second filter adjustment.

10. The non-transitory computer-readable medium of claim 7, further comprising instructions executable to generate a first anti-noise signal with the first adaptive filter to produce the first quiet zone, and generate a second anti-noise signal with the second adaptive filter to produce the second quiet zone.

11. The non-transitory computer-readable medium of claim 10, where the first anti-noise signal is generated in a form to drive a first speaker to produce the first quiet zone, and the second anti-noise signal is generated in a form to drive a second speaker to produce the second quiet zone.

12. The non-transitory computer-readable medium of claim 7, where the first quiet zone, based on the first set of weighting factors, and the second quiet zone, based on the second set of weighting factors, are non-overlapping.

13. The non-transitory computer-readable medium of claim 7, where the instructions to retrieve a first set of weighting factors and a second set of weighting factors further comprises instructions to calculate the first set of weighting factors and the second set of weighting factors.

14. The non-transitory computer-readable medium of claim 7, where the instructions to retrieve a first set of weighting factors and a second set of weighting factors further comprises instructions to retrieve the first set of weighting factors and the second set of weighting factors as predetermined values from a storage location.

15. An active noise control system for creating a quiet zone in a listening area, the active noise control system comprising:

a processor;

a memory in communication with the processor;

where the processor is configured to retrieve a first weighting factor and a second weighting factor from among a plurality of distinct non-zero values, the first weighting factor and the second weighting factor configured to shape an area of the quiet zone within the listening area;

the processor further configured to apply the first weighting factor to a first filter adjustment of a first listening region included in the listening area and apply the second weighting factor to a second filter adjustment of a second listening region included in the listening area;

the processor further configured to update filter coefficients of an adaptive filter included in the active noise control system based on the weighted first filter adjustment and the weighted second filter adjustment; and the processor further configured to generate an anti-noise signal with the updated set of filter coefficients of the adaptive filter to destructively interfere with an undesired sound and create the quiet zone.

16. The active noise control system of claim 15, where the processor is further configured to calculate the first filter adjustment and the second filter adjustment based on a discrete error signal indicative of at least a portion of the undesired sound in the first listening region and the second listening region, a predetermined estimated secondary path transfer function stored in the memory, and the undesired noise.

17. The active noise control system of claim 16, where the processor is further configured to retrieve from the memory a plurality of predetermined estimated secondary path transfer functions each comprising representation of one of a plurality of respective estimated paths between at least one speaker and at least one error microphone in each of the first listening region and the second listening region.

18. A method of creating a quiet zone with an active noise control system in a listening area, the method comprising:

receiving a first error signal indicative of undesired sound in a first listening region and receiving a second error signal indicative of undesired sound in a second listening region:

calculating a first filter adjustment based on the first error signal and the undesired sound, and calculating a second filter adjustment based on the second error signal and the undesired sound;

selecting each of a first weighting factor and a second weighting factor from a plurality of distinct non-zero values to modify the first filter adjustment and the second filter adjustment, respectively;

applying the first weighting to the first filter adjustment of the first listening region included in the listening area and applying the second weighting to the second filter adjustment of the second listening region included in the listening area to establish the quiet zone within the listening area as non-inclusive of both the first listening region and the second listening region;

adjusting filter coefficients of an adaptive filter based on the weighted first filter adjustment and the weighted second filter adjustment; and generating an anti-noise signal to substantially cancel the undesired sound and create the quiet zone.

19. The method of claim 18, where the listening area is a vehicle, the first listening region is a first row of seats, the second listening region is the second row of seats, and applying the first weighting comprises fully weighting the first filter adjustment and applying the second weighting comprises less than fully weighting the second filter adjustment to establish the quiet zone to include only the first row of seats.

20. The method of claim 19, further comprising increasing the weighting of the second error signal to increase the quiet zone to include at least part of the second row of seats.

21. The method of claim 18, where applying the first weighting to the first error signal and applying the second weighting to the second error signal comprises detecting an occupancy in the listening area and selecting the first weighting and the second weighting so the detected occupancy is included in the quiet zone.

22. A method of creating a quiet zone with an active noise control system, the method comprising:

calculating a first filter adjustment based on a first error signal representative of undesired sound in a first listening zone and calculating a second filter adjustment based on a second error signal representative of undesired sound in a second listening zone;

setting each of a first weighting factor and a second weighting factor to respective values selected from a plurality of distinct non-zero values;

applying the first weighting factor to the first filter adjustment and the second weighting factor to the second filter adjustment; and adjusting an adaptive filter based on the weighted first filter adjustment and the weighted second filter adjustment to establish a size of the quiet zone to exclude at least a part of the first listening zone and the second listening zone.

23. The method of claim 22, further comprising generating an anti-noise signal to substantially cancel the undesired sound in at least part of one of the first listening zone and the second listening zone in accordance with the size of the quiet zone.

24. The method of claim 22, where calculating the first filter adjustment and the second filter adjustment comprises calculating the first filter adjustment and the second filter adjustment also based on an estimated filtered undesired noise signal in each of the first listening zone and the second listening zone.

25. A method of creating a quiet zone with an active noise control system, the method comprising:

providing a plurality of secondary path transfer functions representative of a plurality respective paths between at least one speaker and at least one error microphone;

calculating a first filter adjustment for a first listening region based on at least a first one of the secondary path transfer functions and calculating a second filter adjustment for a second listening region based on at least a second one of the secondary path transfer functions that is different than the first one of the secondary path transfer functions;

selecting a first weighting factor to adjust but not eliminate the first filter adjustment and a second weighting factor to adjust but not eliminate the second filter adjustment, the first weighting factor different from the second weighting factor;

applying the first weighting factor to the first filter adjustment and the second weighting factor to the second filter adjustment;

adjusting an adaptive filter with the weighted first filter adjustment and the weighted second filter adjustment to establish a size of the quiet zone; and generating an anti-noise signal with the adjusted adaptive filter to substantially cancel the undesired sound.

26. The method of claim 25, further comprising:

receiving a first error signal from a first listening region and receiving a second error signal from a second listening region, the first listening region and the second listening region being subject to the undesired sound;

calculating the first filter adjustment based on the at least a first one of the secondary path transfer functions and the first error signal; and calculating the second filter adjustment based on the at least a second one of the secondary path transfer functions and the second error signal.

27. The method of claim 26, where adjusting the adaptive filter comprises adjusting the adaptive filter with the weighted first filter adjustment and the weighted second filter adjustment to establish a size of the quiet zone to exclude at least a part of the first listening region and the second listening region.

28. The method of claim 25, where generating an anti-noise signal with the adjusted adaptive filter comprises generating the anti-noise signal to substantially cancel the undesired sound in at least part of one of a first listening region and a second listening region included in the listening area, where the first listening region includes the first one of the secondary path transfer functions, and the second listening region includes the second one of the secondary path transfer functions.

29. A method of creating a quiet zone with an active noise control system, the method comprising:

providing a plurality of secondary path transfer functions representative of a plurality respective paths between at least one speaker and at least one error microphone;

receiving a first error signal from a first listening area and receiving a second error signal from a second listening area, the first listening area and the second listening area being subject to an undesired sound;

calculating a first filter adjustment of an adaptive filter based on the first error signal and at least one of the secondary path transfer functions and calculating a second filter adjustment of the adaptive filter based on the second error signal at least one of the secondary path transfer functions;

applying a first non-zero weighting factor to the first filter adjustment and a second non-zero weighting factor to the second filter adjustment, the first weighting factor different from the second weighting factor; and updating coefficients of the adaptive filter with both the weighted first filter adjustment and the weighted second filter adjustment to produce the quiet zone to exclude at least part of the second listening area.

* * * * *

UNITED STATES PATENT AND TRADEMARK OFFICE

CERTIFICATE OF CORRECTION

PATENT NO. : 9,020,158 B2
APPLICATION NO. : 12/420658
DATED : April 28, 2015
INVENTOR(S) : Duane Wertz et al.

It is certified that error appears in the above-identified patent and that said Letters Patent is hereby corrected as shown below:

On the title page Delete "Related U.S. Application Data

(63) Continuation-in-part of application No. 12/275,118 filed on Nov. 20, 2008."

In the specification,

Column 1, Line 1:
Delete the first paragraph as shown below:

"PRIORITY CLAIM

The present patent document is a continuation-in-part of U.S. patent application Ser. No. 12/275,118, filed Nov. 20, 2008 entitled SYSTEM FOR ACTIVE NOISE CONTROL WITH AUDIO SIGNAL COMPENSATION. The disclosure of U.S. patent application Ser. No. 12/275,118 is incorporated herein by reference."

Signed and Sealed this
Twentieth Day of October, 2015

Michelle K. Lee

Michelle K. Lee
*Director of the United States Patent and Trademark Office*